US005184676A

United States Patent [19]

Graham et al.

[11] Patent Number: 5,184,676

[45] Date of Patent: Feb. 9, 1993

[54] SELF-PROPELLED APPARATUS

[76] Inventors: Gordon A. Graham, 28 Tuscan Street, Rossmoyne W.A. 6155; William V. Pasznicki, 5 Pavetta Crescent, Forrestfield W.A. 6058; William F. Connell, Lot 186 Old Northam Road, Chidlow W.A. 6556; Kenneth V. Pratley, P.O. Box 5, Chidlow W.A. 6556, all of Australia

[21] Appl. No.: 660,896

[22] Filed: Feb. 26, 1991

[30] Foreign Application Priority Data

Feb. 26, 1990 [AU] Australia ..... PJ 8810

[51] Int. Cl.[5] ..... E21B 23/00

[52] U.S. Cl. ..... 166/66.4; 166/50; 166/66.5; 166/104

[58] Field of Search ..... 166/66.4, 65.1, 66.5, 166/50, 206, 381, 104; 181/102; 175/98, 99

[56] References Cited

U.S. PATENT DOCUMENTS

| | | | |
|---|---|---|---|
| 2,776,564 | 1/1957 | Montgomery et al. | 166/64 X |
| 3,405,772 | 10/1968 | Wisenbaker et al. | 175/94 X |
| 3,827,512 | 8/1974 | Edmond | 175/94 |
| 4,071,086 | 1/1978 | Bennett | 166/177 |
| 4,192,380 | 3/1980 | Smith | 166/250 |
| 4,243,099 | 1/1981 | Rodgers, Jr. | 166/66.4 |
| 4,670,862 | 6/1987 | Staron et al. | 181/102 X |
| 4,676,310 | 6/1987 | Scherbatskoy et al. | 166/65.1 |
| 4,686,653 | 8/1987 | Staron et al. | 175/99 X |
| 4,715,469 | 12/1987 | Yasuda et al. | 181/102 |

FOREIGN PATENT DOCUMENTS

| | | |
|---|---|---|
| 1559442 | 1/1980 | United Kingdom . |
| 1580469 | 12/1980 | United Kingdom . |

*Primary Examiner*—Hoang C. Dang
*Attorney, Agent, or Firm*—Foley & Lardner

[57] ABSTRACT

A self-propelled powered apparatus for traveling along a tubular member includes power driven wheels for propelling the apparatus, a biasing means for biasing the driven wheels into contact with the inner surface of the tubular member, and a retracting means for retracting the driven wheels from the driving position so that the apparatus can be withdrawn from the tubular member. The retracting means also include means to automatically retract the driven wheels from the driving position when the power to the apparatus is cut-off.

12 Claims, 28 Drawing Sheets

SELF-PROPELLED APPARATUS

The present invention relates to a self-propelled apparatus and in particular, but not exclusively, to a self-propelled apparatus for travelling down tubular members, such as pipes and well casings.

In the oil, gas and mining industry, it is often necessary to transport various tools and devices, for example logging tools or perforating guns, down pipes and wells. When a well runs vertically down into the ground, such tools and devices may be simply transported down the well by means of gravity. However, when the wells are inclined to the vertical or run horizontally, the effects of gravity are not sufficient for transportation. This problem can be overcome by pushing various tools or devices down hole on the end of a pipe having its length increased by attaching successive lengths of pipe together. However, this method of transportation is very slow and accordingly significantly increases the costs involved in the task at hand.

It is an object of the present invention to provide a self-propelled apparatus for travelling down pipes which substantially alleviates at least one of the deficiencies in the described prior art.

In accordance with one aspect of the invention there is provided a self-propelled apparatus for travelling along a tubular member or shaft comprising:

means for anchoring said apparatus to an inside surface of said tubular member or shaft to substantially prevent movement of the apparatus in a direction opposite a direction of travel;

means for propelling said apparatus in a direction of travel of the apparatus; and, retracting means for disengaging the anchoring means from the inside surface of the tubular member or shaft thereby allowing the apparatus to be withdrawn from said tubular member or shaft in a direction opposite the direction of travel, wherein said propelling means and said anchoring means are mechanically coupled in a manner whereby, said propelling means can cooperate with said anchoring means to propel said apparatus in the direction of travel.

Preferably said propelling means comprises a reciprocating means and said anchor means comprises first and second anchor portions respectfully disposed forward and rearward of said propelling means.

Alternatively said propelling means comprises impact means for cyclically imparting momentum to the apparatus in the direction of travel. Preferably the impact means includes a solenoid provided with a moving armature.

Advantageously, the self-propelled apparatus may also include second propelling means for providing continuous drive to the apparatus in the direction of travel. Preferably said second propelling means comprises a pair of driven wheels disposed at opposite ends of a support arm pivotally connected intermediate its length to said apparatus and biased such that the said wheels are urged to contact the inside surface of said tubular member or shaft.

In accordance with another aspect of the present invention there is provided a self propelled apparatus for travelling along a tubular member or shaft comprising:

means for propelling said apparatus in a direction of travel;

means for biasing said propelling means into a driving position in contact with the surface of said tubular member or shaft whereby drive can be imparted by said propelling means against said inner surface to propel said apparatus in the direction of travel;

means for retracting said propelling means from said driving position whereby said apparatus can be withdrawn from said tubular member or shaft in a direction opposite the direction of travel.

Preferably said biasing means and said propelling means, when in said driving position are arranged to substantially prevent movement of the apparatus in a direction opposite the direction of travel.

Preferably the biasing means is adapted to increase the bias on the propelling means when in a driving position in response to a force applied to the apparatus in a direction opposite the direction of travel.

Preferably the propelling means comprises driven wheels.

Preferably said biasing means includes first and second resilient elements, said first resilient element arranged to bias said wheels towards said inner surface, said second resilient element arranged to bias said wheels away from said inner surface, the bias provided by said second resilient element being greater than that provided by the first resilient element and, compressing means for overcoming the bias provided by the second resilient element, whereby, when said compressing means is activated said compressing means operates to overcome the bias of the second resilient element and said first resilient element biases said wheels towards and into contact with said inner surface, and when to said compressing means is deactivated, said second resilient element acts against said first resilient element to bias said wheels away from and out of contact with said inner surface.

Preferably said bias means further includes an arm connected by a pivot pin intermediate its length to said apparatus and respective ones of said wheels are rotatably connected at opposite ends of said arm, and bias from said first resilient element is transmitted to said arm so as to urge said arm to pivot about said pivot pin and said wheels to contact said inside surface when said compressing means is activated.

Alternatively said biasing means further includes:

first and second support arms, each support arm having a first end pivotally connected to a common slidable pivot pin; and first and second gear arms, each gear arm having a first end pivotally connected to a second end of a respective support arm by means of an axle, second ends of each gear arm being coaxially pivotably connected to said apparatus, wherein each wheel is rotatably mounted on respective ones of said axles, and bias from said first elements is transmitted to said support and gear arms so as to urge said wheels into contact with the inner surface when said compressing means is activated.

Preferably said slidable pivot pin is arranged for linear translation in a direction substantially parallel to the direction of travel.

Preferably each gear arm is provided with at least one gear for transmitting torque to a corresponding one of said wheels and each of said at least one gear is driven by a common transmission gear.

Preferably when said driven wheels are in contact with said inner surface the torque of said wheels acts to increase the traction of said wheels in response to a force applied in a direction opposite the direction of travel.

Advantageously the traction means may include friction material or pointed dogs disposed around the periphery of the wheels.

Advantageously the self propelled apparatus further comprises second propelling means for advancing said apparatus in the direction of travel. Preferably said second propelling means includes a reciprocating means, and the apparatus further comprises means for anchoring the apparatus to the inside surface of a tubular member or shaft to substantially prevent movement of the apparatus in a direction opposite a direction of travel, wherein the second propelling means is disposed between the bias means and the anchoring means.

Alternatively, said second propelling means comprises an impact means for cyclically imparting momentum to the apparatus in the direction of travel.

Several embodiments of the present invention will now be described, by way of example only, with reference to the accompanying drawings in which;

FIG. 1 is a block diagram of a self propelled apparatus for travelling down pipes;

FIGS. 2A & 2B when joined end to end illustrate a longitudinal sectional view of one embodiment of an anchor and retractor for use in one embodiment of the apparatus;

Figure 6A:
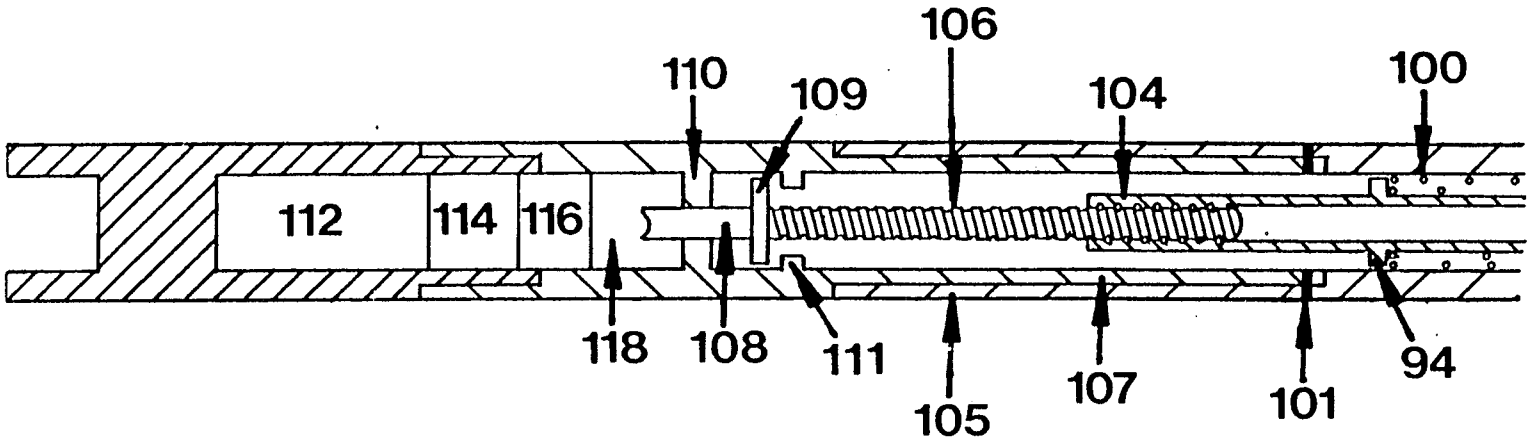
Figure 6B:
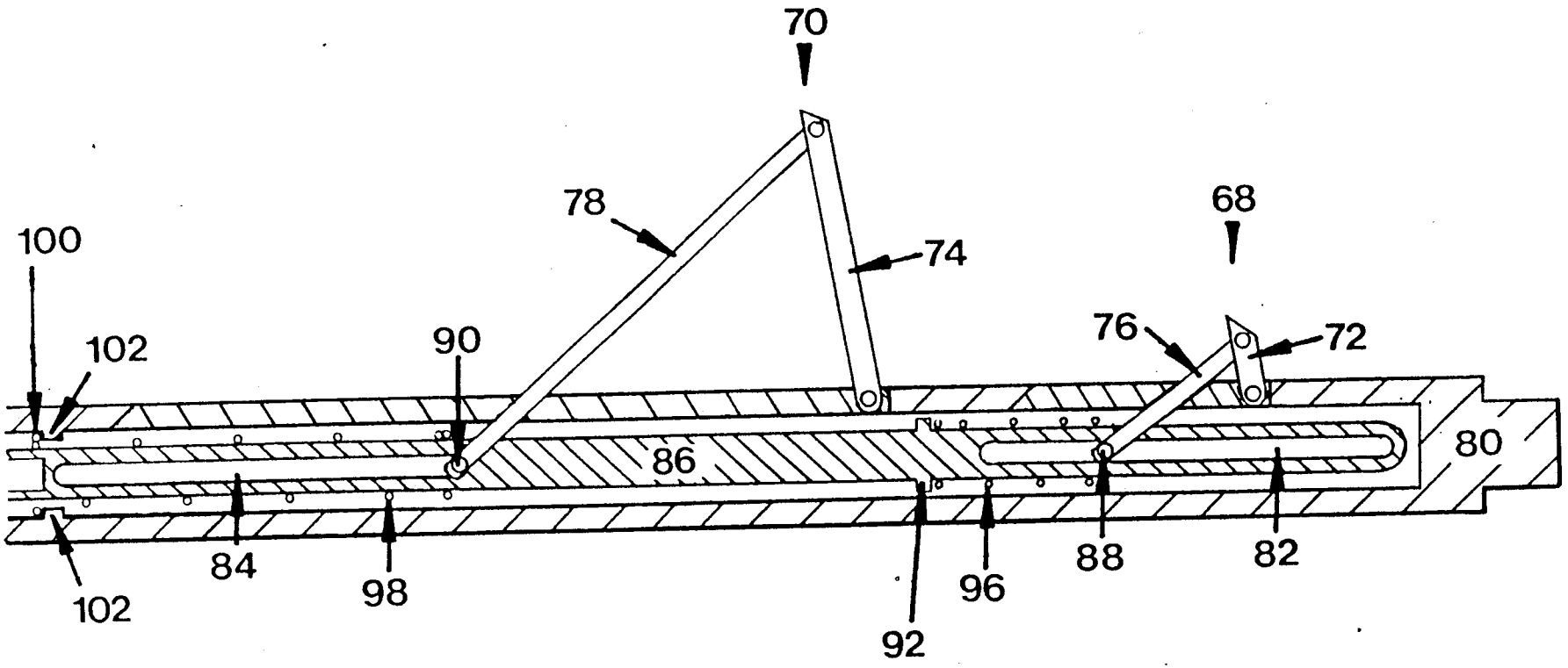
Figure 7:
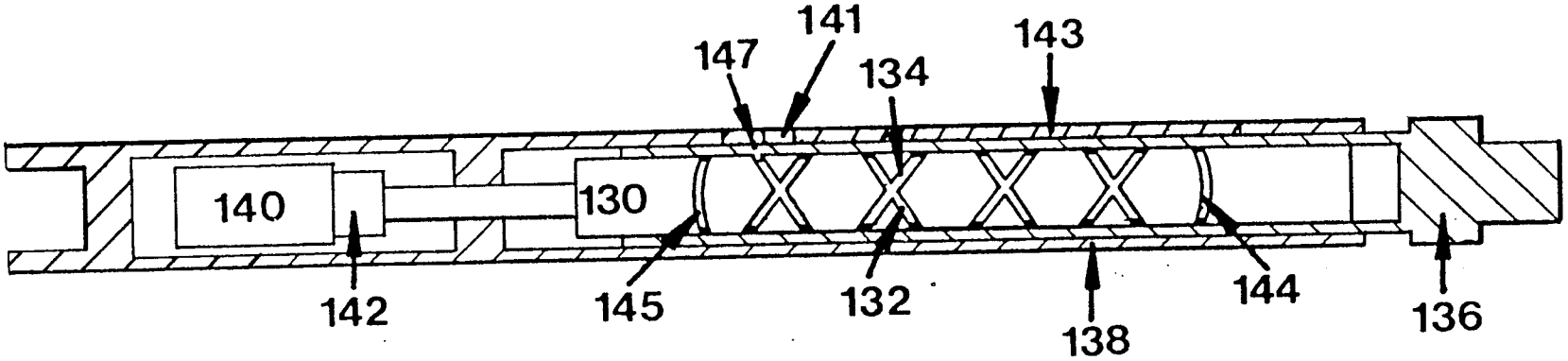
Figure 8:
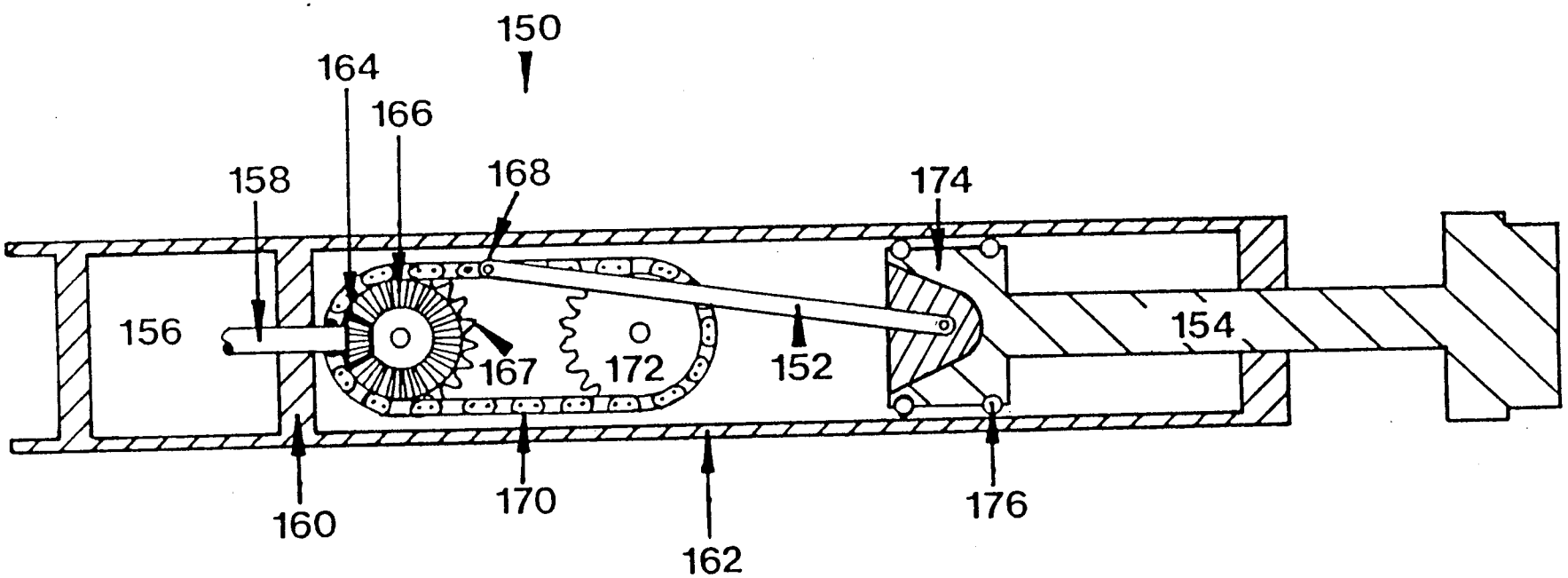
Figure 9A:
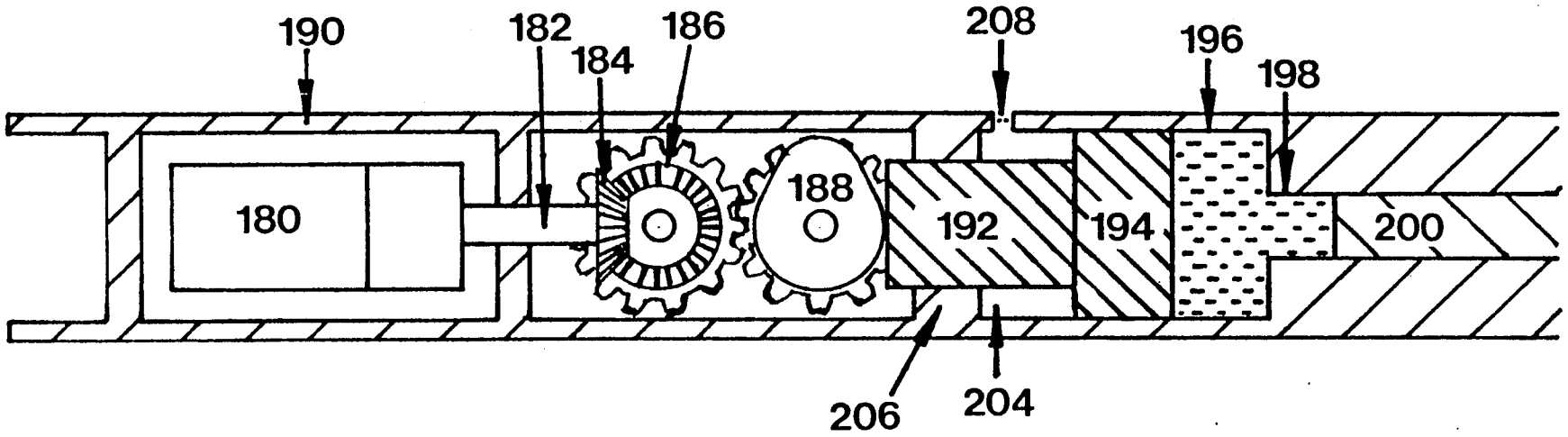
Figure 9B:
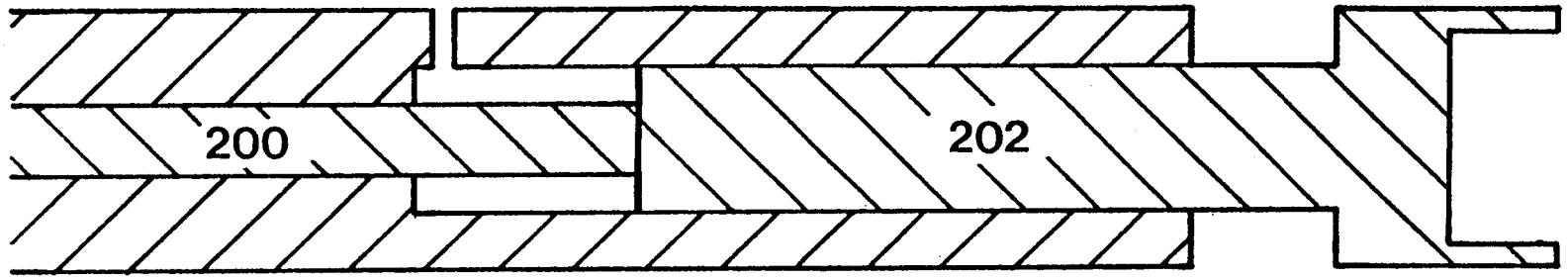
Figure 10:
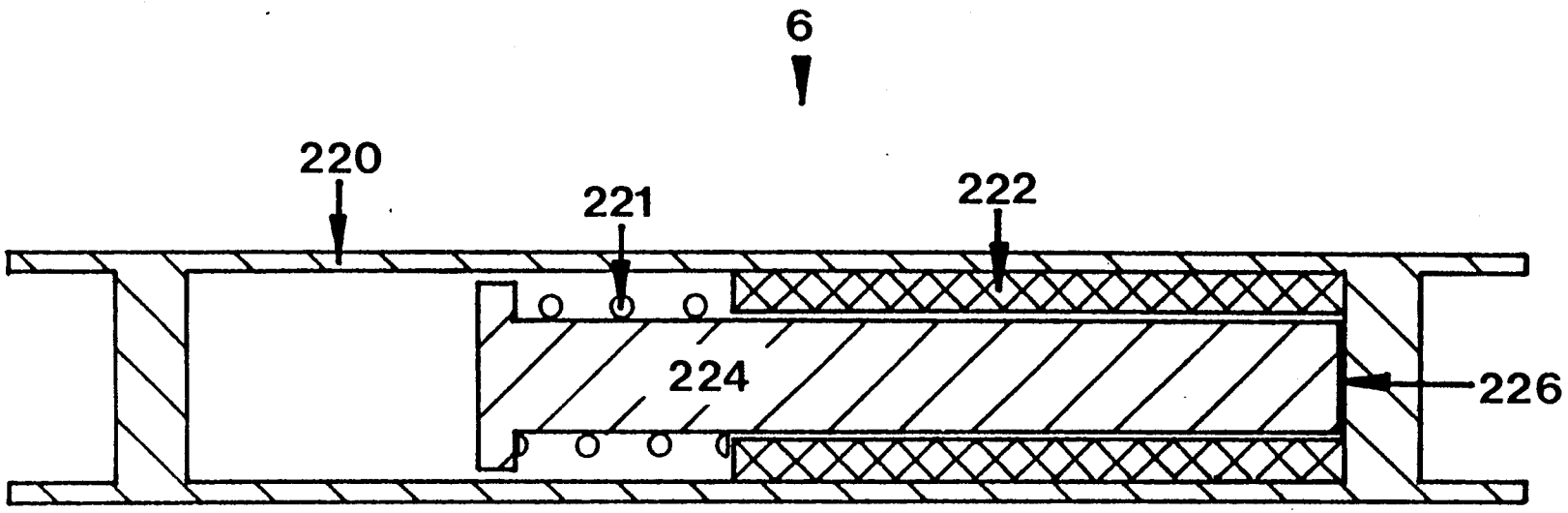
Figure 11A:
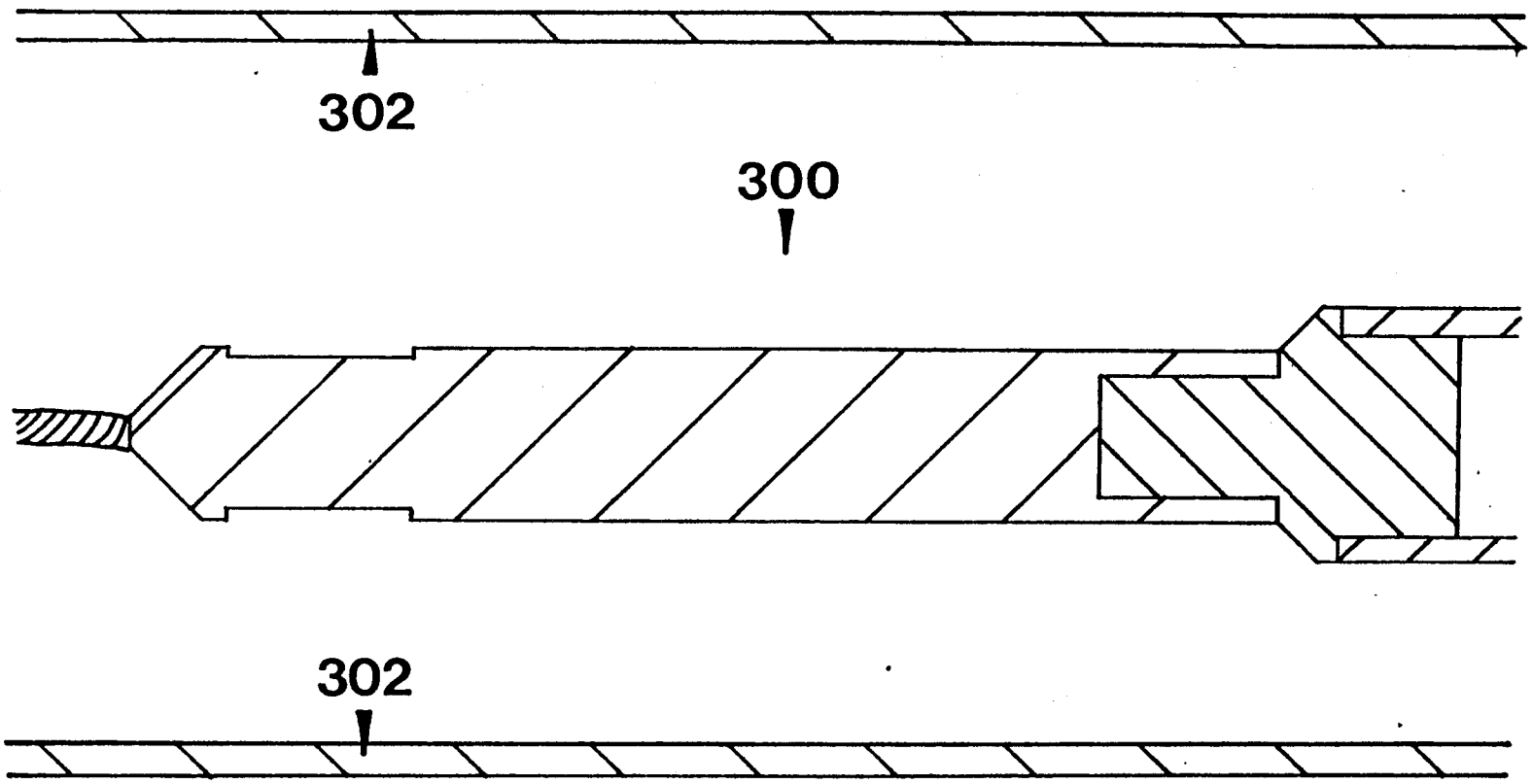
Figure 11B:
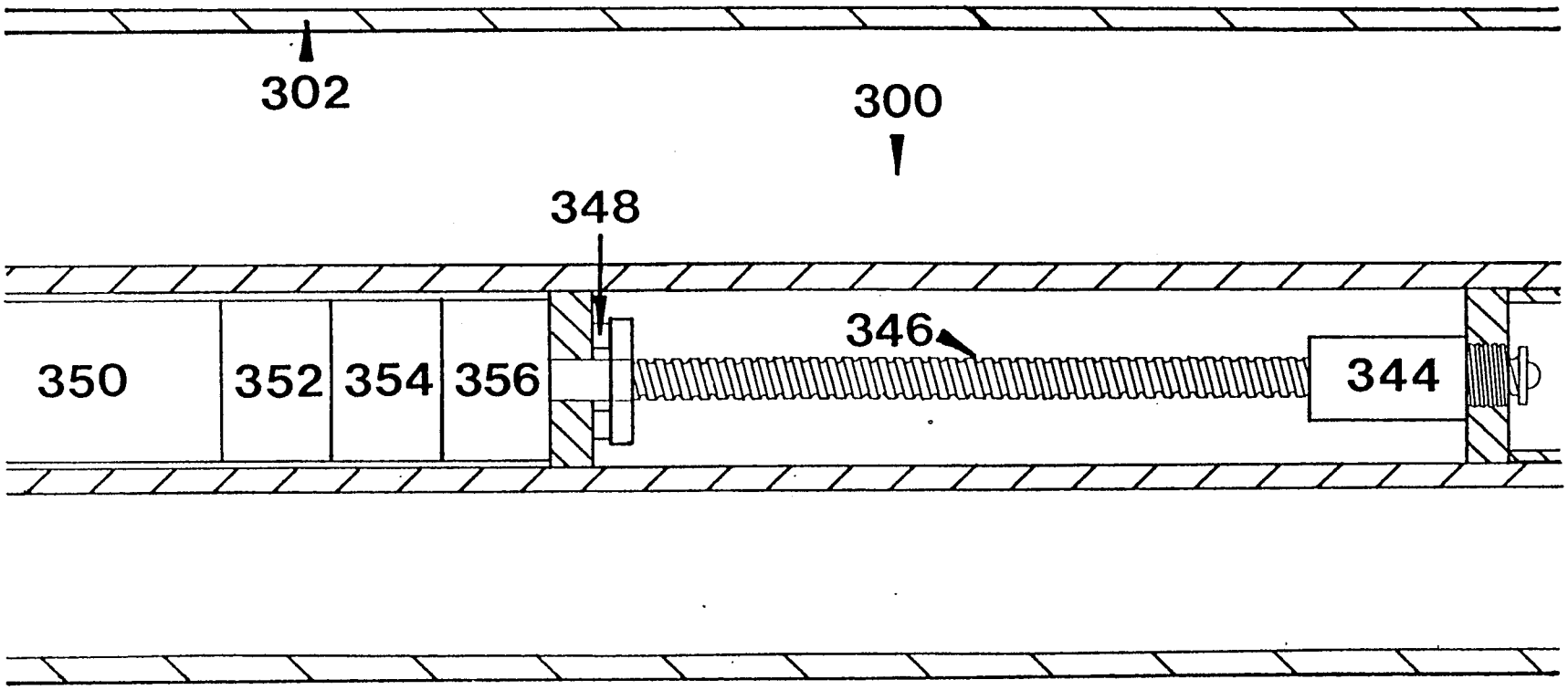
Figure 11C:
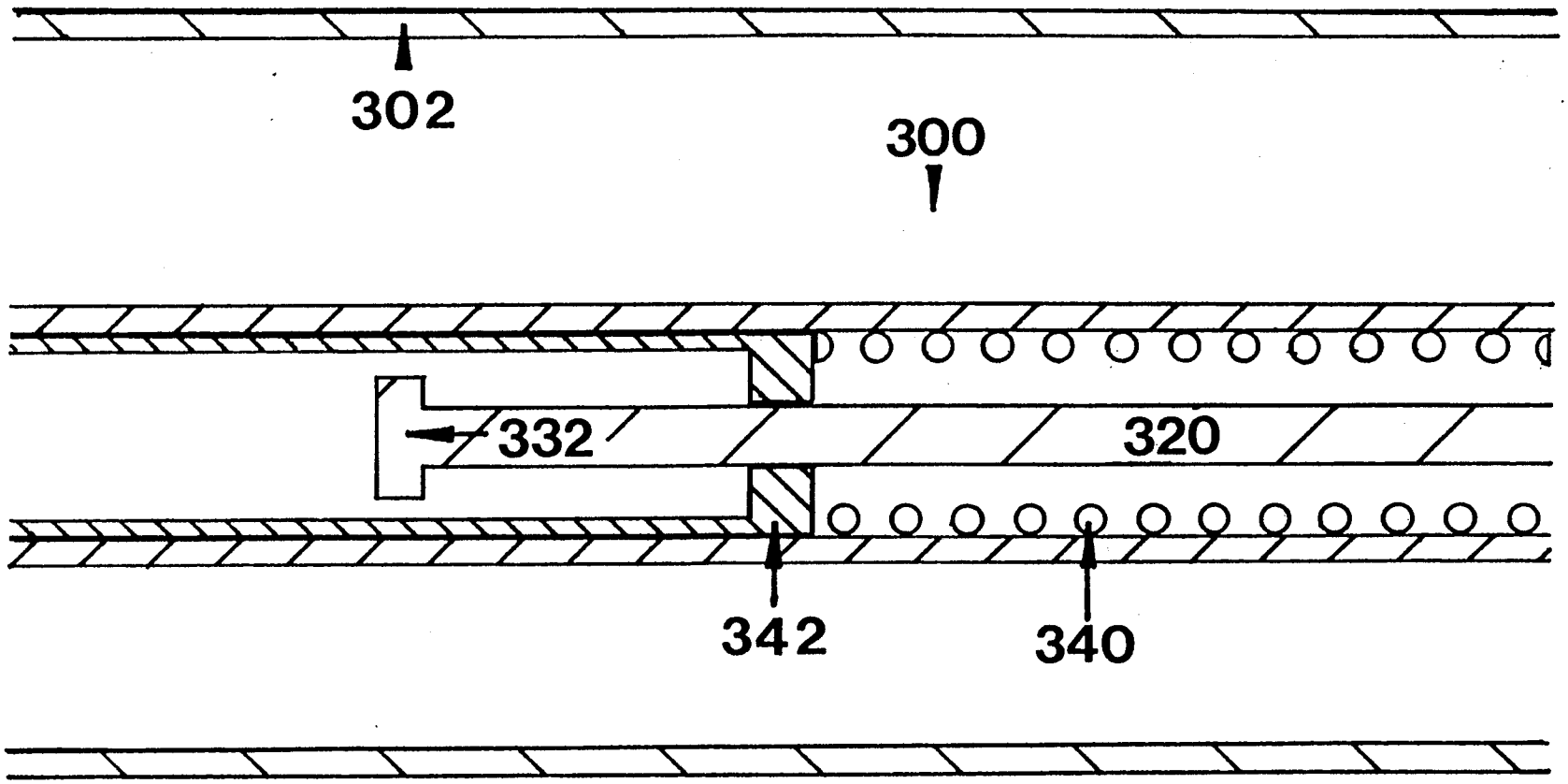
Figure 11D:
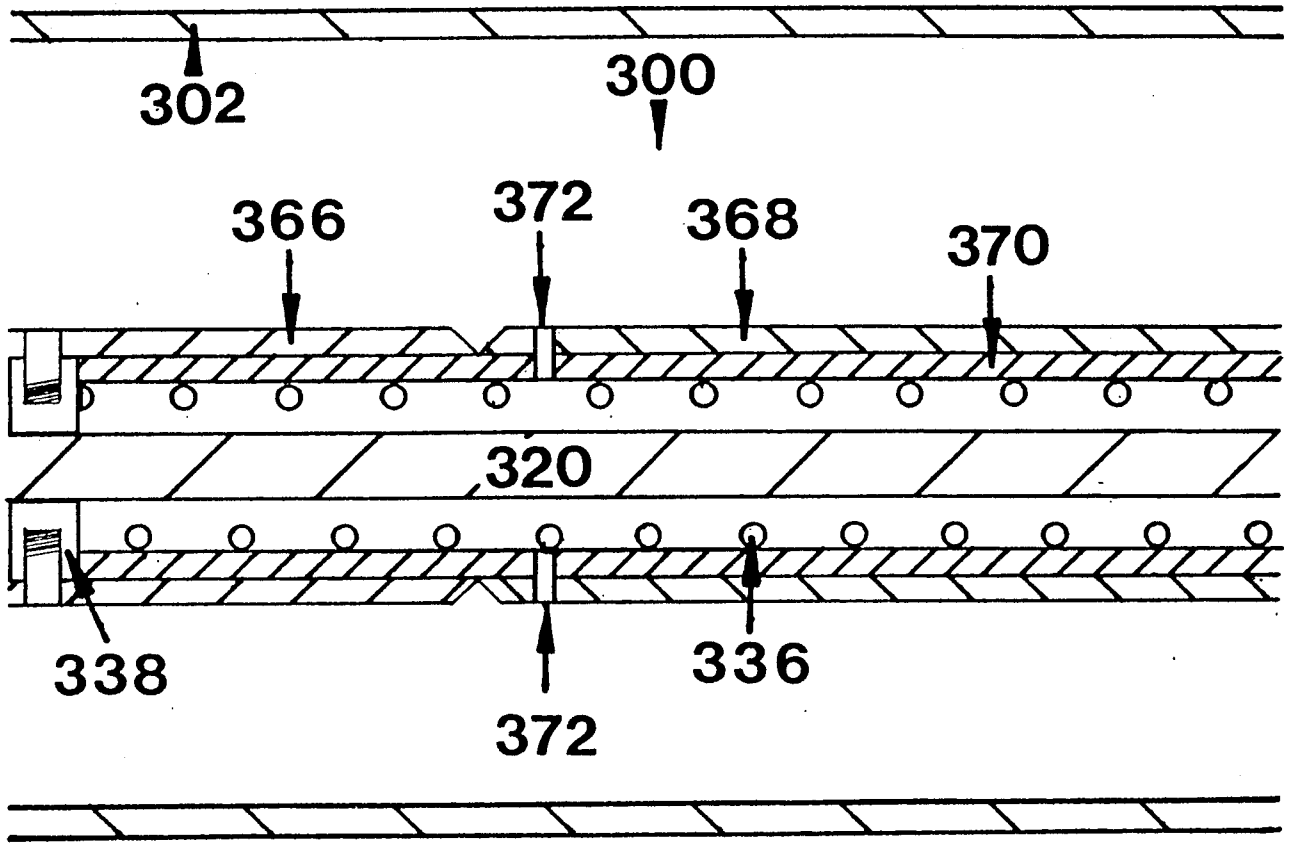
Figure 11E:
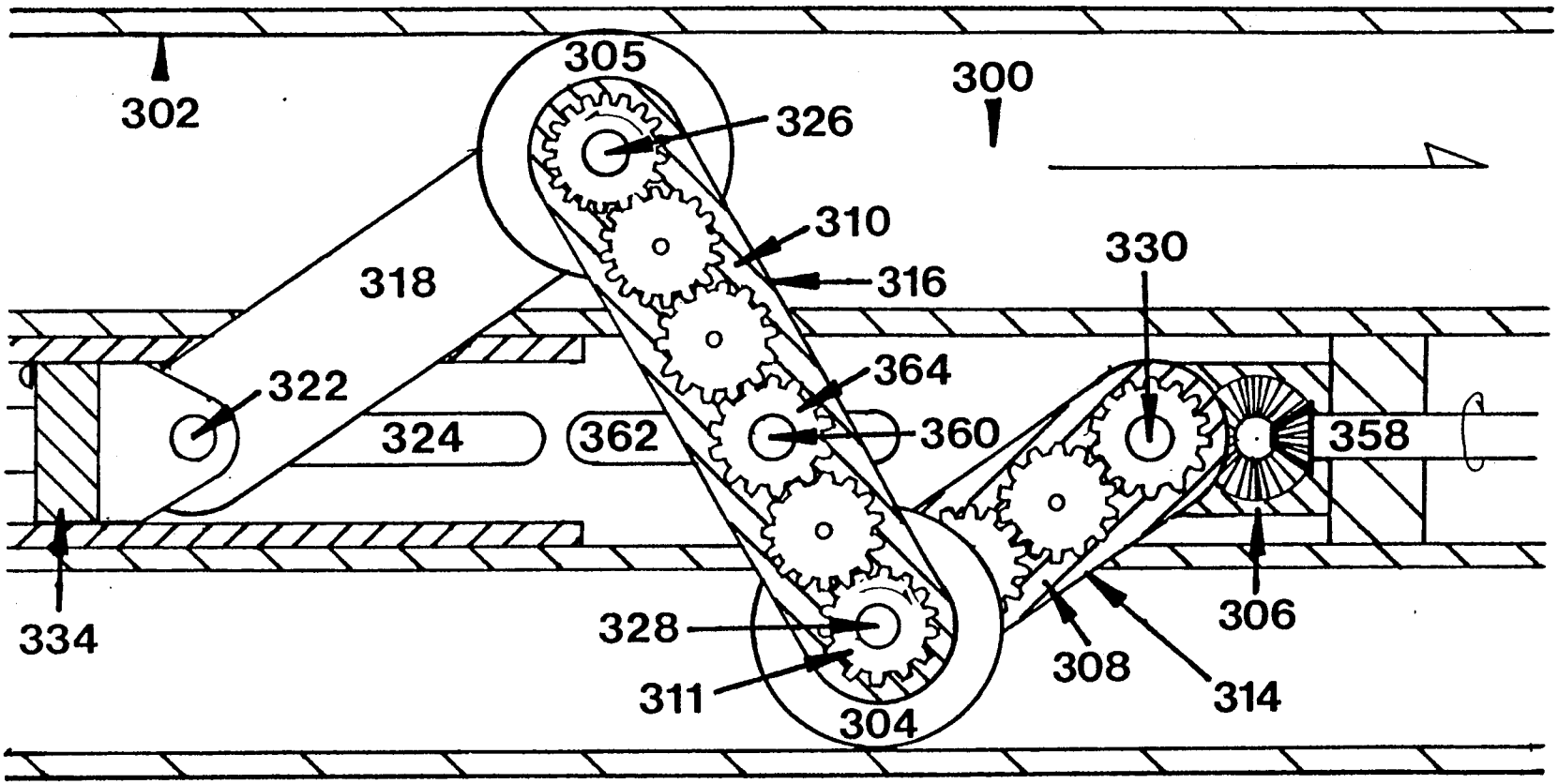
Figure 11F:
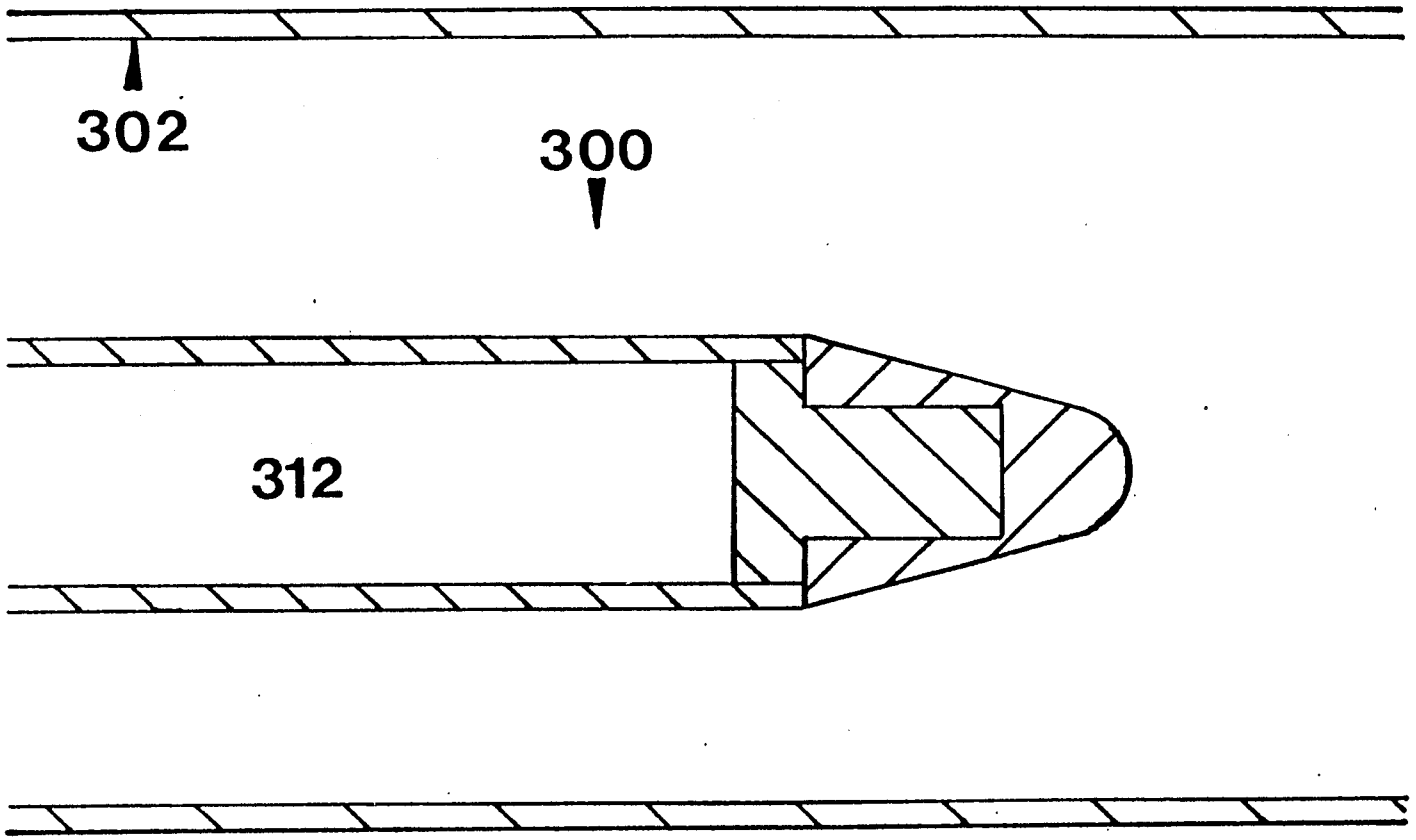
Figure 12A:
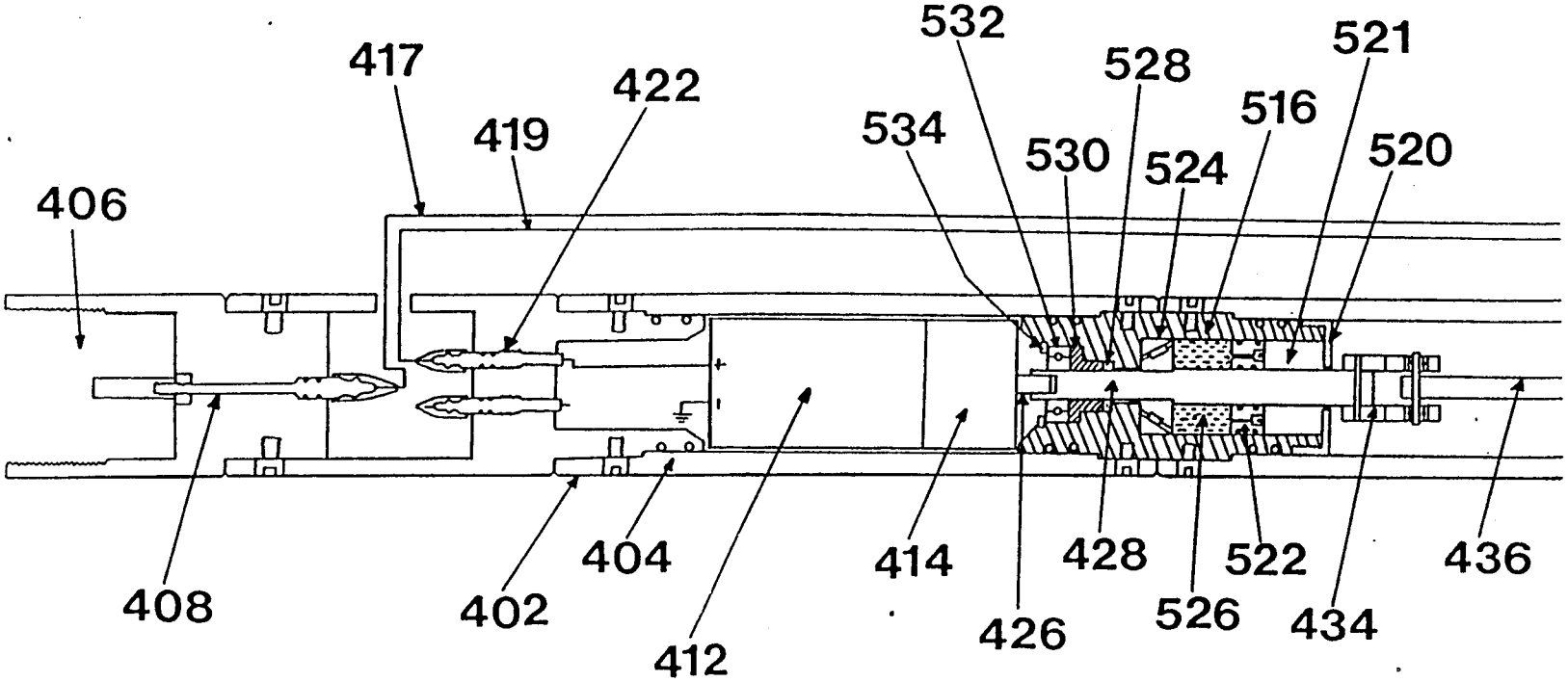
Figure 12B:
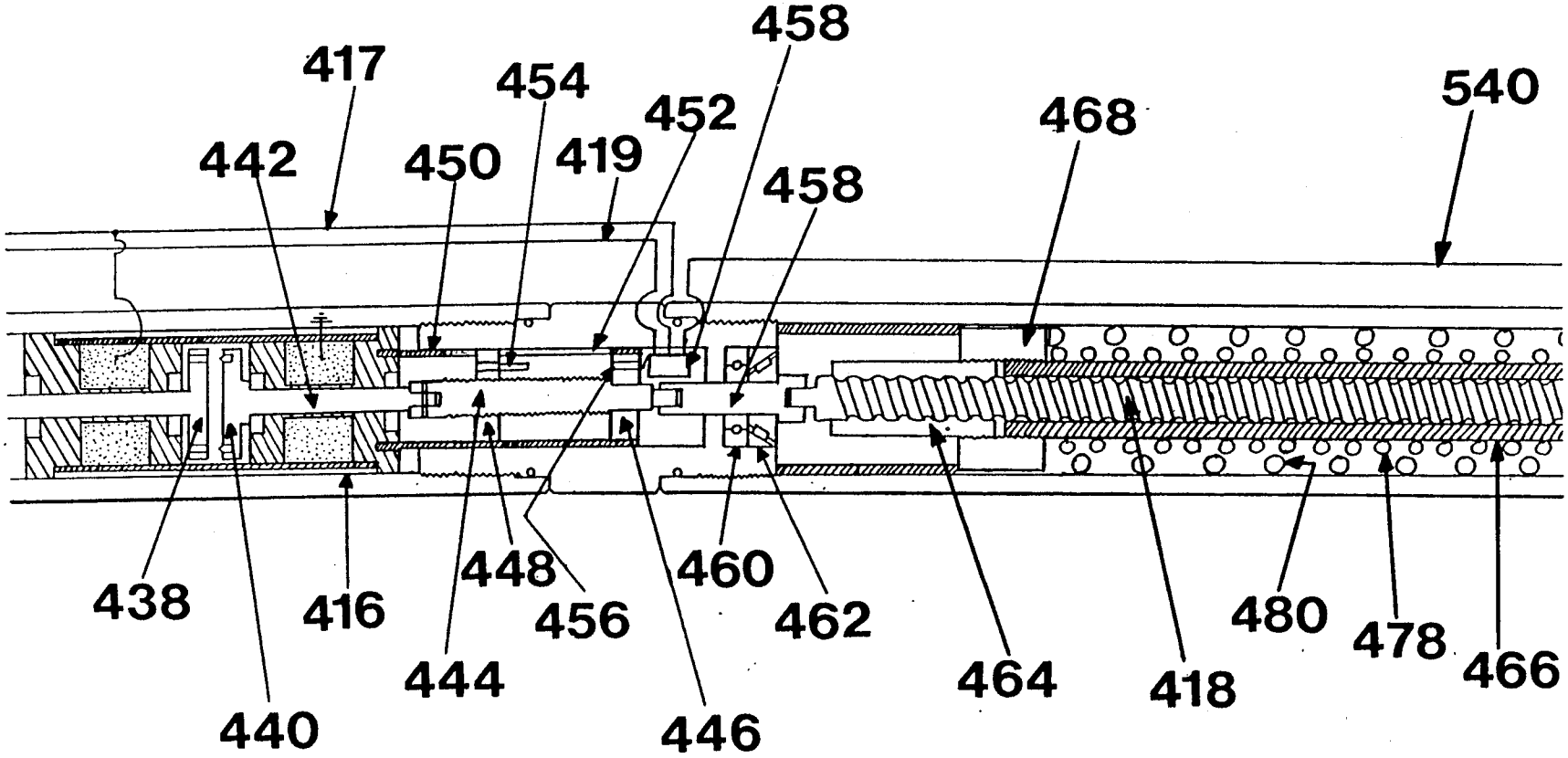
Figure 12C:
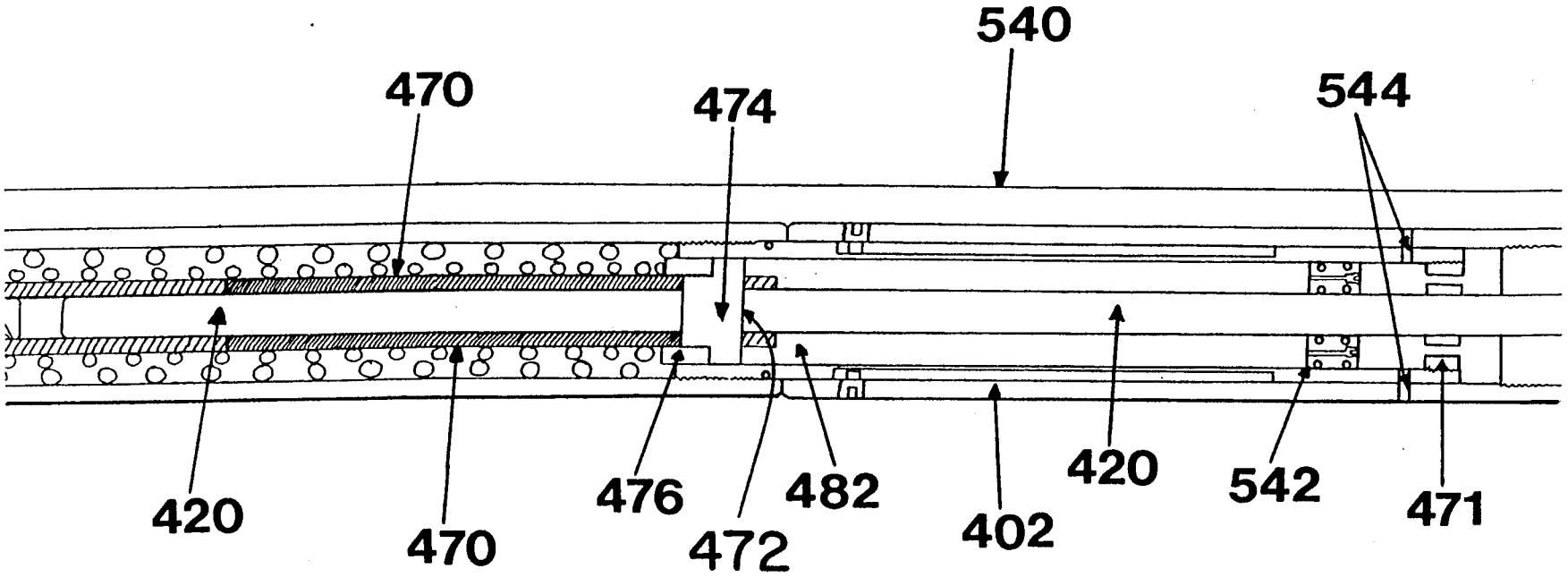
Figure 12D:
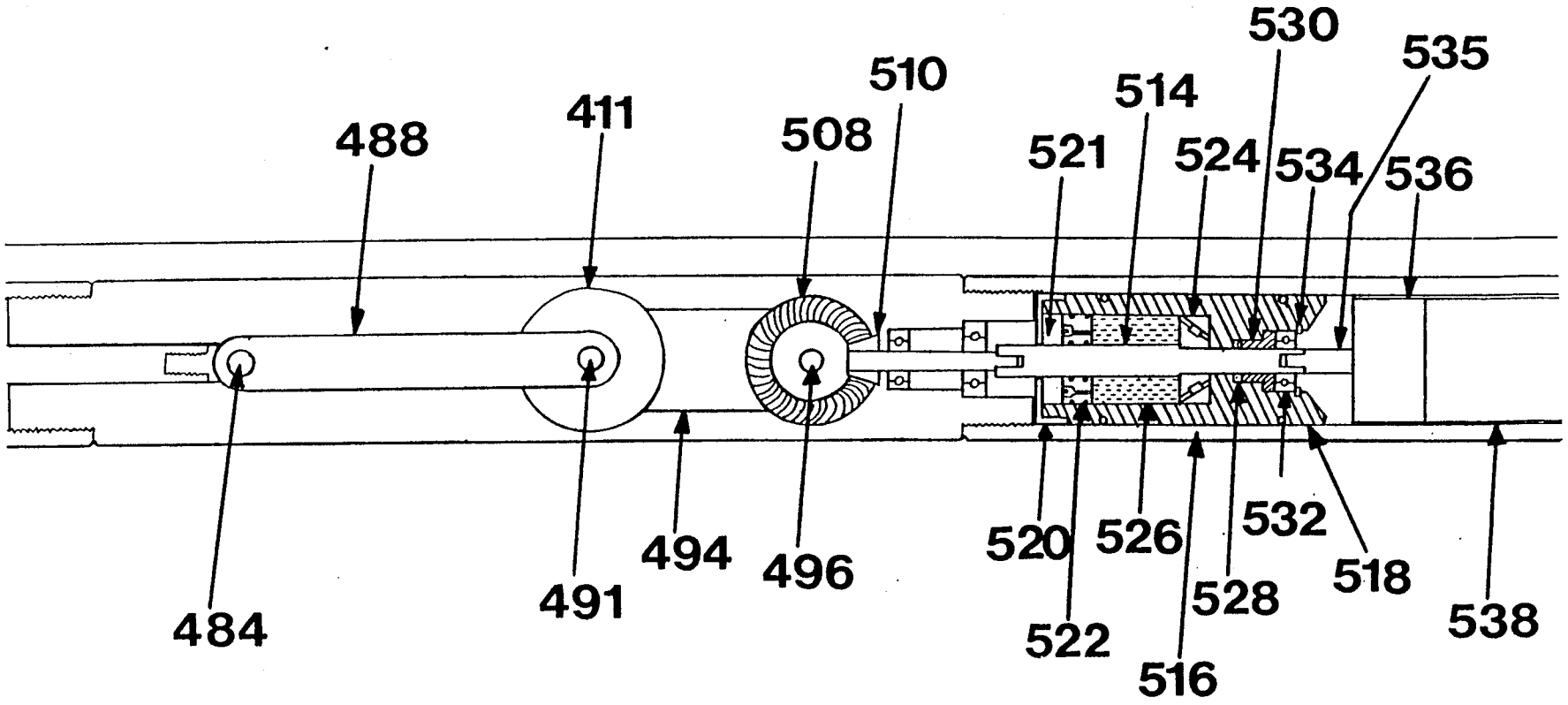
Figure 12E:
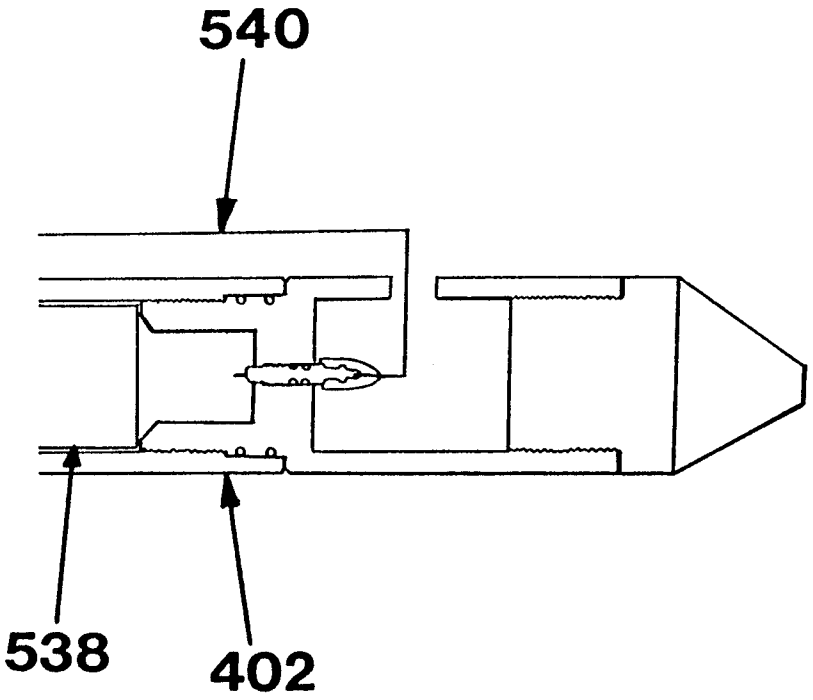
Figure 13:
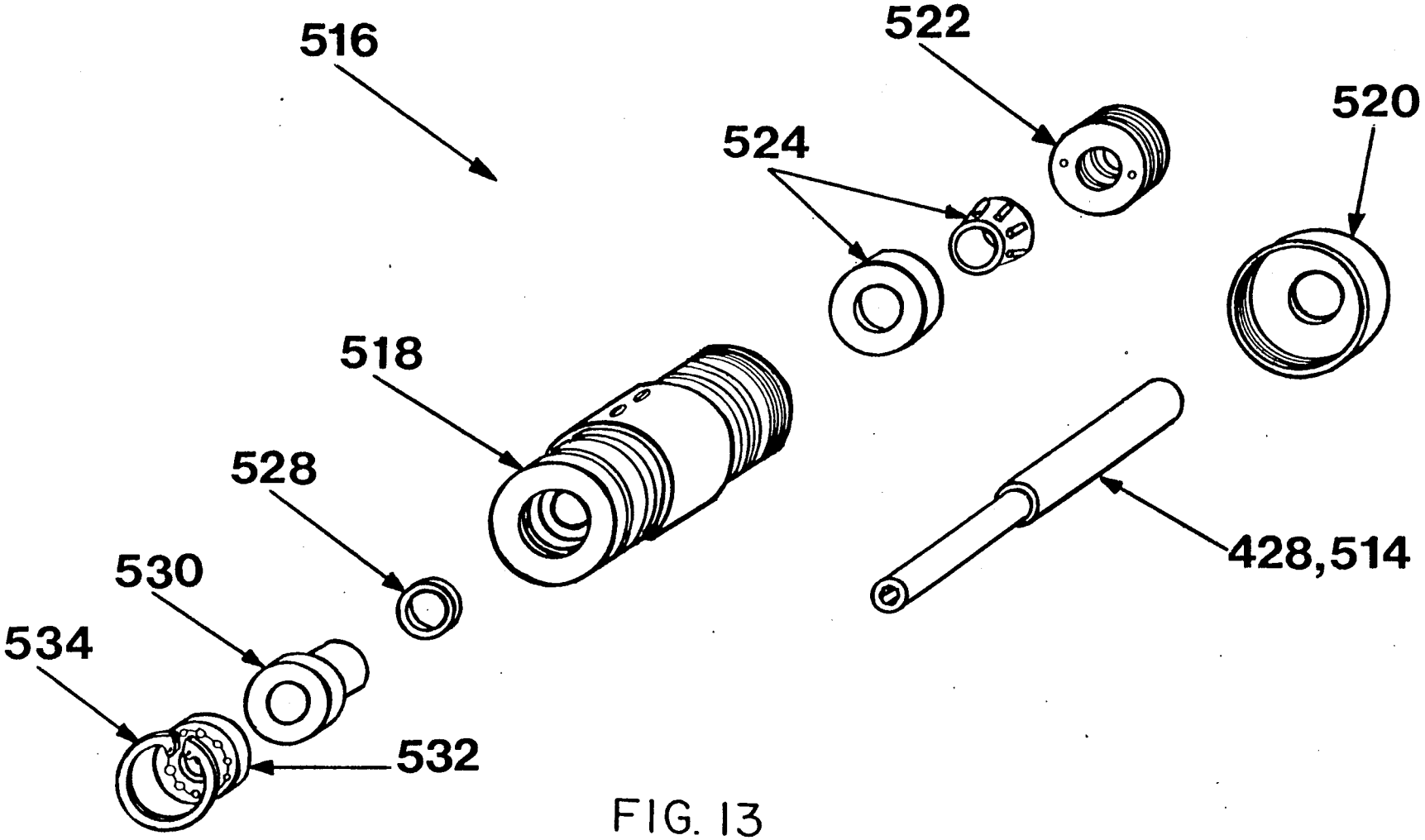
Figure 14:
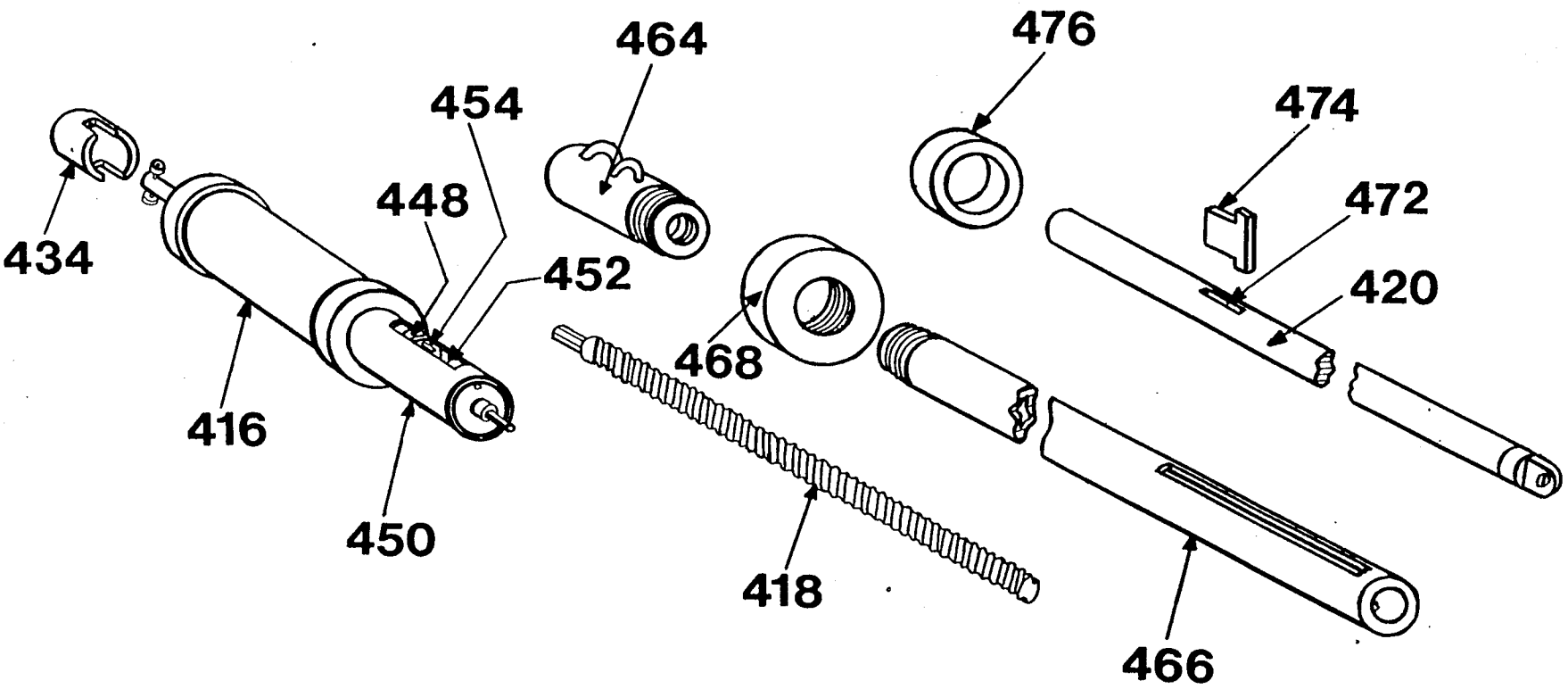
Figure 15:
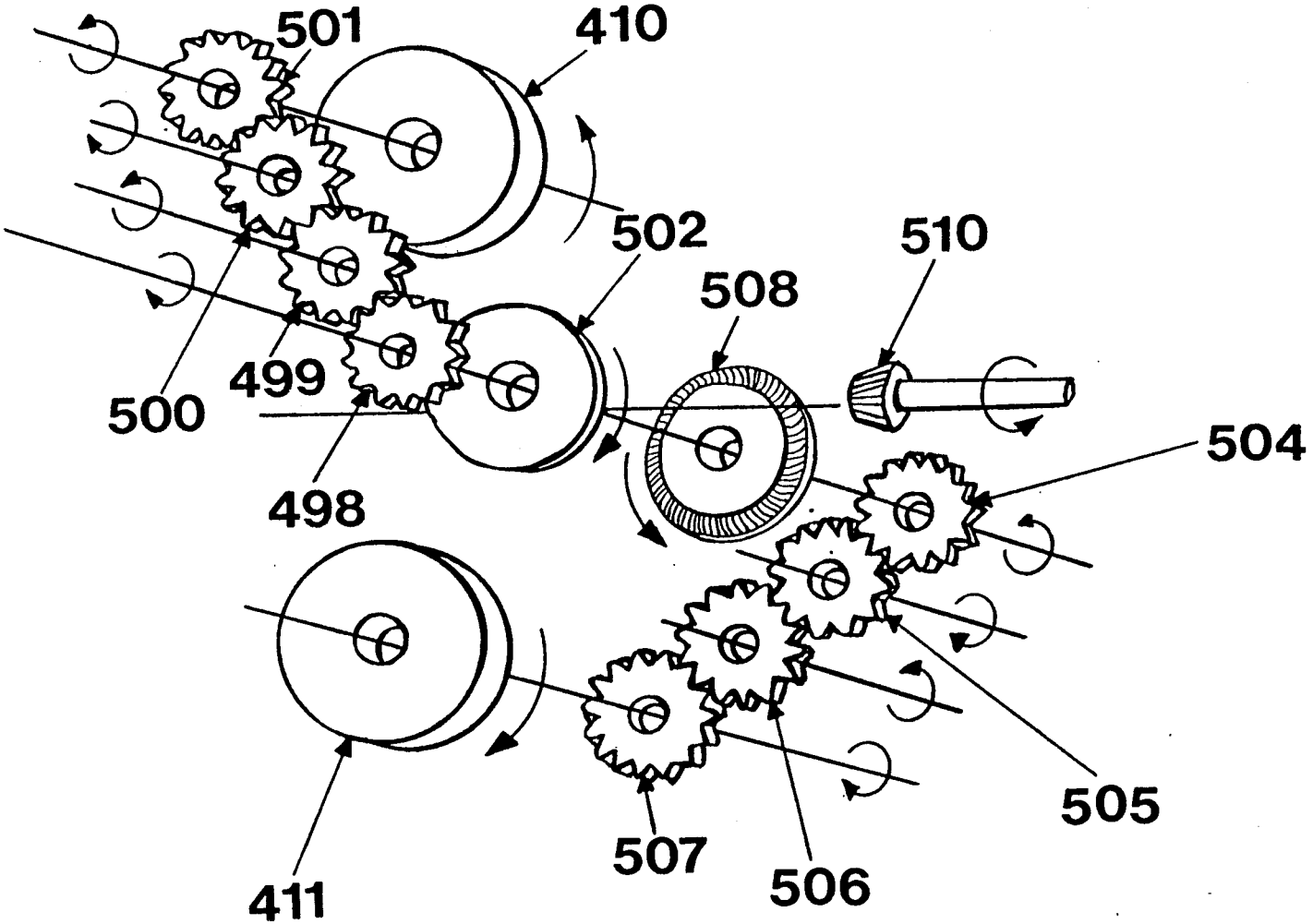
Figure 16:
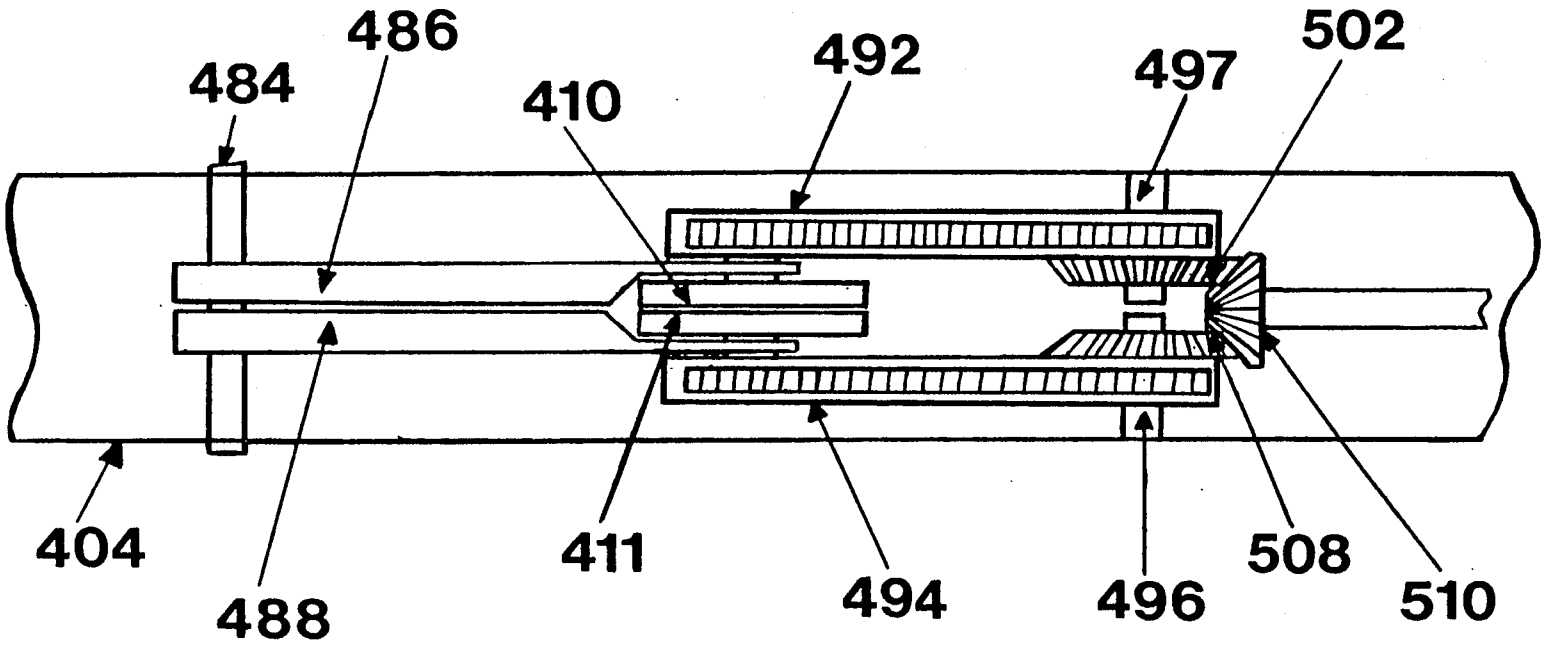
Figure 17:
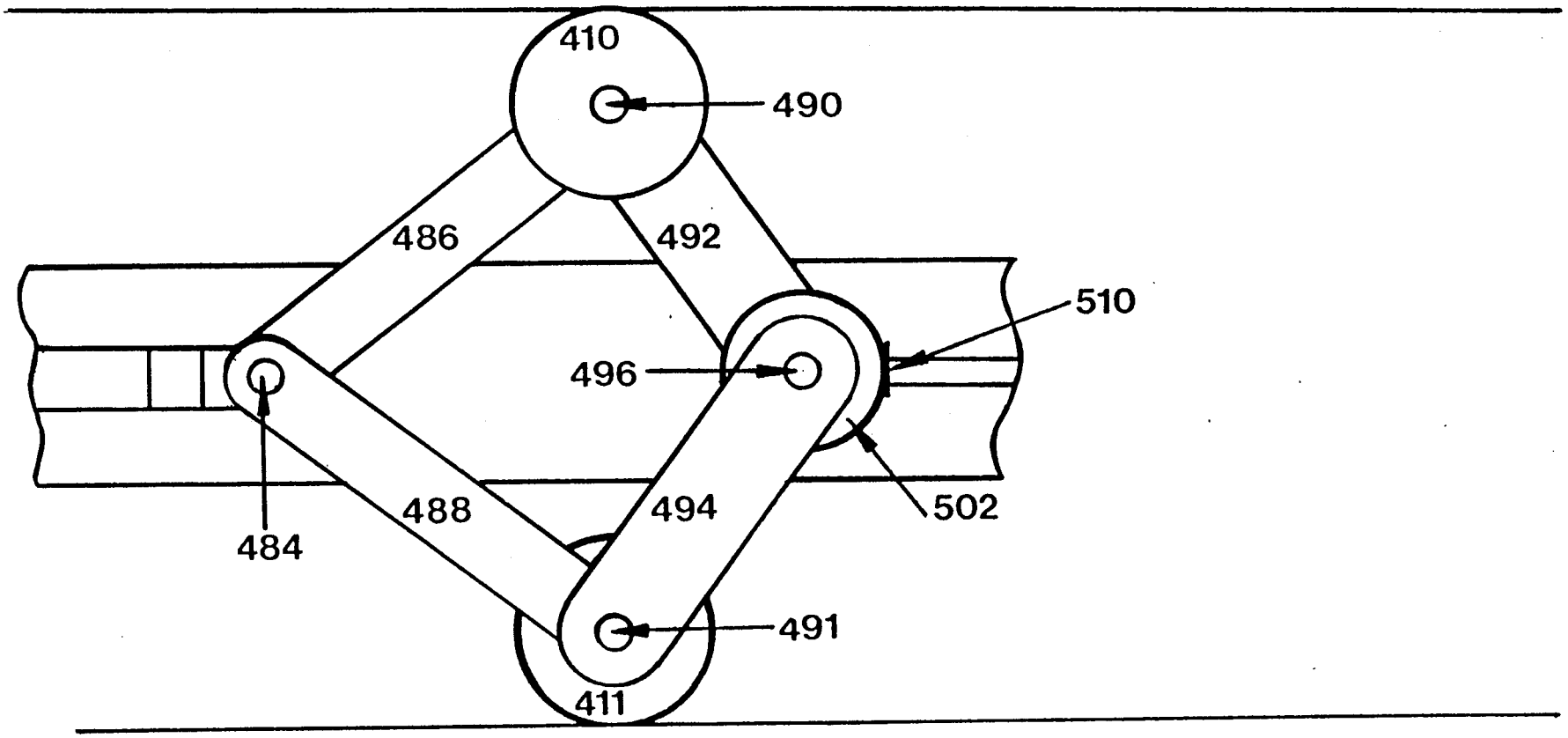

FIGS. 6A & 6B when joined end to end illustrate a longitudinal sectional view of an anchor and retractor for use in a second embodiment of the apparatus;

FIG. 7 illustrates a longitudinal sectional view of a means for propelling the apparatus;

FIG. 8 is a longitudinal sectional view of a propelling means for use in a second embodiment of the apparatus;

FIG. 9 is a longitudinal sectional view of a propelling means for use in a third embodiment of the apparatus;

FIG. 10 is a longitudinal sectional view of a propelling means for use in a fourth embodiment of the apparatus;

FIGS. 11A, 11B & 11C when joined end to end illustrate a further embodiment of the apparatus;

FIGS. 12A, 12B, 12C, 12D and 12E when joined end to end show a longitudinal sectional view of a further embodiment of the apparatus;

FIG. 13 is an exploded perspective view of a sealing/thrust adaptor incorporated in the apparatus illustrated in FIGS. 12A to 12E;

FIG. 14 is an exploded perspective view of various components of the apparatus shown in FIGS. 12A to 12E;

FIG. 15 is an exploded perspective view of driving wheels and gears incorporated in the apparatus illustrated in FIGS. 12A to 12E;

FIG. 16 is a view from the top of the driving wheels and gears illustrated in FIG. 15; and, FIG. 17 is a view from the side of the driving wheels when in a drive position.

Figure 1:
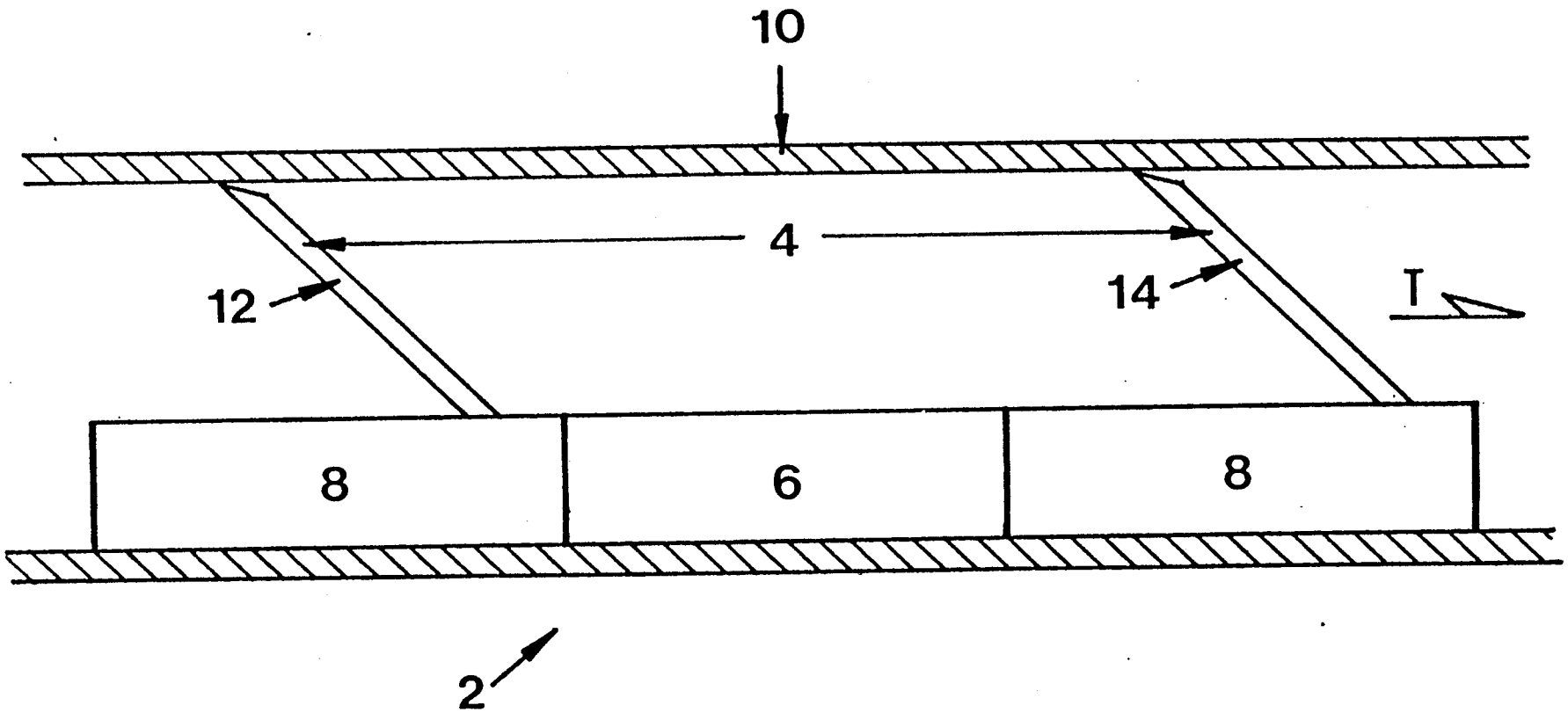

A first embodiment of the self-propelled apparatus 2 is illustrated inside a pipe 10 in FIG. 1. The apparatus 2 is travelling towards the right hand side of the page as indicated by arrow T. The self-propelled apparatus 2 comprises anchor means 4 which engages the inside surface of the pipe 10 thereby preventing the apparatus 2 from movement in a direction opposite the direction of travel T. The anchor means 4 has a front portion 14 and rear portion 12 respectively coupled to the front and rear of a propelling means 6 which propels the apparatus 2 in the direction T. During a first period of operation of the propelling means 6, the rear portion 12 of the anchor 4 prevents movement of the apparatus 2 in a direction opposite the direction of travel T, but the front portion 14 of the anchor 4 is driven in the direction of travel T. During a second period of operation of the propelling means 6, the front portion 14 of the anchor means 4 engages the inner surface of the pipe 10 and prevents the apparatus 2 from moving in a direction opposite the direction of travel T. However, the rear portion 12 of the anchor means 4 is driven towards the direction of travel T. In this manner, the apparatus 2 travels along the pipe 10 in a direction of travel T in a caterpillar-like manner. When it is desired to withdraw the apparatus 2 from the pipe 10, the retracting means 8 operates so as to retract the anchor means 4 into a position within the confines of the apparatus 2, thereby disengaging the pipe 10 and allowing the apparatus 2 to be pulled out of the pipe 10 in a direction opposite the direction of travel T.

Figure 2A:
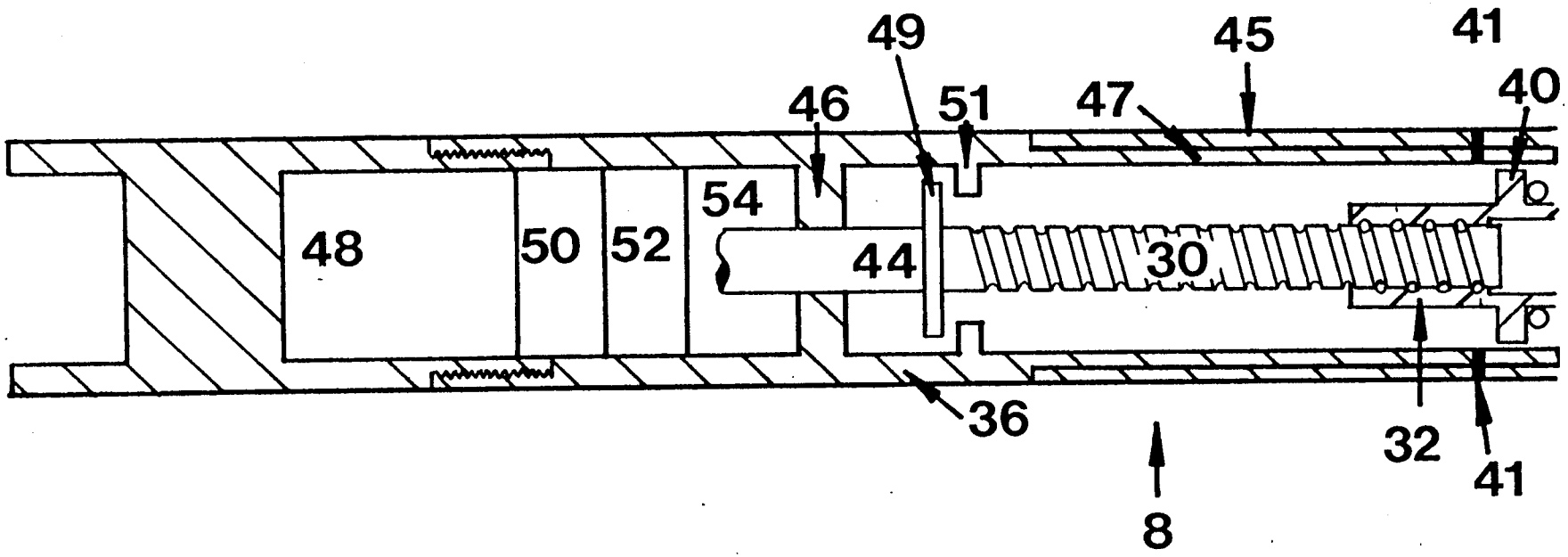
Figure 2B:
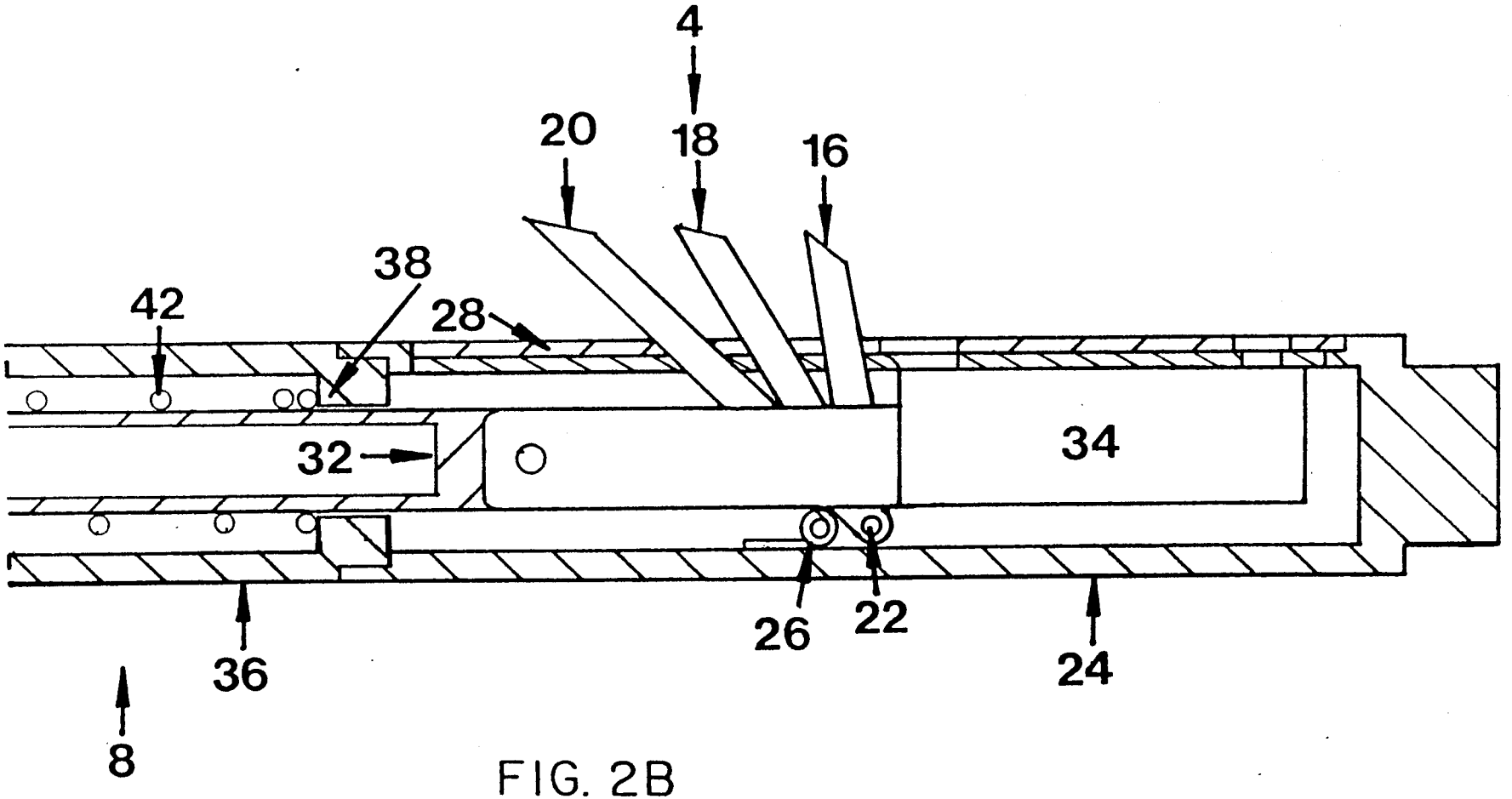

FIGS. 2A & 2B illustrate one possible form of anchor 4 and retractor 8. The anchor 4 comprises three arms 16, 18 and 20 of increasing length. Arms 18 and 20 are bifurcated such that the smallest arm 16 fits within the bifurcations of arm 18 and arm 18 fits within the bifurcations of arm 20. A pin 22, passing through a lower end of the arm 16 and through the bifurcations of arms 18 and 20, pivotally connects the arms to the anchor casing 24. Biasing means such as springs 26 (only one shown) are provided to urge the respective arms 16, 18 and 20 in a direction away from the anchor casing 24 and into contact with the inner surface of a pipe 10. A slot 28 is provided along the top of the anchor casing 24 to allow the arms 16, 18 and 20 to move into and out of the anchor casing 24.

The retractor 8 is attached to one end of the anchor casing 24. The retractor 8 includes a ball screw 30, a shaft 32 having at one end an internal thread for receiving the ball screw 30 and, a closing block 34 attached to the opposite end of the shaft 32. The ball screw 30 and shaft 32 are housed within the retractor casing 36, and the closing block 34 is housed in the anchor casing 24. An unthreaded portion 44 of the ball screw 30 is rotatably mounted in a cross-bar 46 transversely spanning the inside of the retractor casing 36. The interior of the retractor casing 36 near the anchor casing 24 is provided with an increased diameter portion forming a stop 38. A closing spring 42 surrounds a portion of the shaft 32 and is maintained in position between the stop 38 and a flange 40 provided on the shaft 32. Torque is provided to the ball screw 30 by means of a motor 48, gear box 50, torque setting clutch 52 and magnetic clutch 54.

Figure 3:
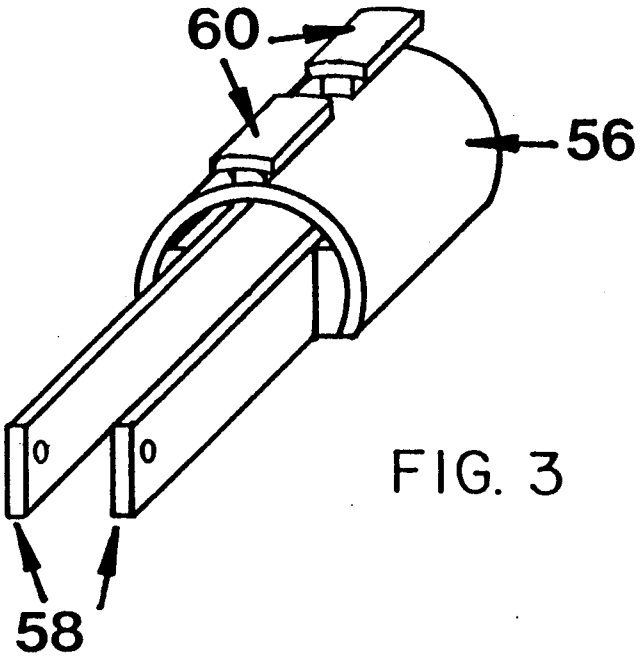
FIG. 3 is a perspective view of the closing block.
Figure 4:
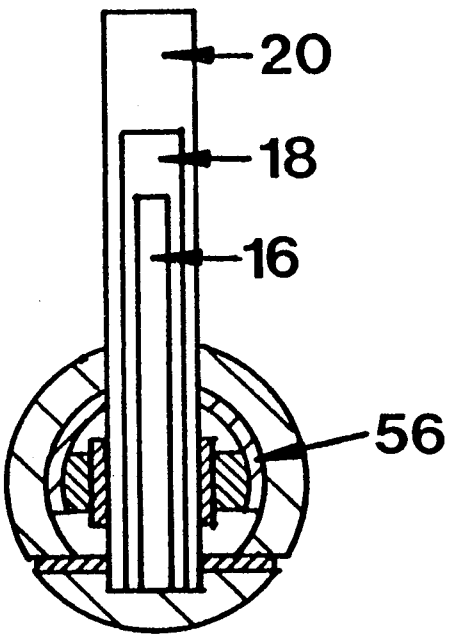
FIG. 4 is a cross-sectional view of an anchor arm and a closing block respectively incorporated in the anchor and retractor of FIGS. 2A & 2B.

As illustrated in FIGS. 3 and 4 the closing block 34 comprises a semi-circular shell 56 with two parallel spaced apart arms 58 extending horizontally from one end. The arms 58 surround the anchor arms 16, 18 and 20. The shell 56 is provided with tracking members 60 on the upper most portion of its upper surface. The tracking members 60 slide within the slot 28 provided in the anchor casing 24.

The operation of the anchor 4 and the retractor 8 will now be described. When no power is provided to the motor 48 and the magnetic clutch 54, the closing spring 42 extends to its maximum length. With maximum extension of the spring 42, the closing block 34 is biased towards the retractor casing 36 and shuts down the anchor arms 16, 18 and 20. In this regard, the spring constant of closing spring 42 is greater than that of springs 26. Thus, with all power off, the anchor arms 16, 18 and 20 are disposed wholly within the anchor casing 24 and no anchoring is possible. When the motor 48 is powered, torque is imparted to the ball screw 30 via the gear box 50, torque setting clutch 52 and magnetic clutch 54. Turning of the ball screw 30 forces the shaft 32 towards the anchor casing 24, compressing the spring 42. The movement of the shaft 32 causes the closing block 34, to move in the same direction releasing the arms 16, 18 and 20 so that they can project through the slot 28 of the anchor casing 24 and engage the inner surface of the pipe 10. The torque setting clutch 52 is adjusted so that the closing spring 42 is fully compressed. At full compression of the spring 42, a micro-switch (not shown) shuts off power to the motor 48 but keeps the magnetic clutch 54 energised. While the magnetic clutch 54 is energised the ball screw 30 is unable to rotate and thus the closing spring 42 is maintained in its compressed state. Depending on the diameter of the pipe or casing within which the apparatus 2 travels, one of the anchor arms 16, 18 and 20 will engage the inner surface of pipe 10 preventing the apparatus 2 from movement in a direction opposite the direction of travel.

If the apparatus 2 is now pulled in a direction opposite the direction of travel, one of the arms 16, 18 or 20 will engage the inner surface of the pipe 10 and wedge the apparatus 2 in a fixed position. The diameter of the pipe 10 determines at what angle the respective arms 16, 18 and 20 extend from the casing 24. If this angle is too small, a respective arm will not grip the pipe and the apparatus 2 will merely slide if pulled in a direction opposite the direction of travel. However, a shorter arm which extends at a greater angle to the anchor casing 24, will grip the inner surface of a pipe and therefore provide the anchoring action. By the provision of more than one anchor arm, it is possible to provide an apparatus 2 capable of travelling through pipes of more than one diameter. Although it is to be recognised that a single anchor arm will provide effective anchoring over a range of pipe diameters.

Figure 5:
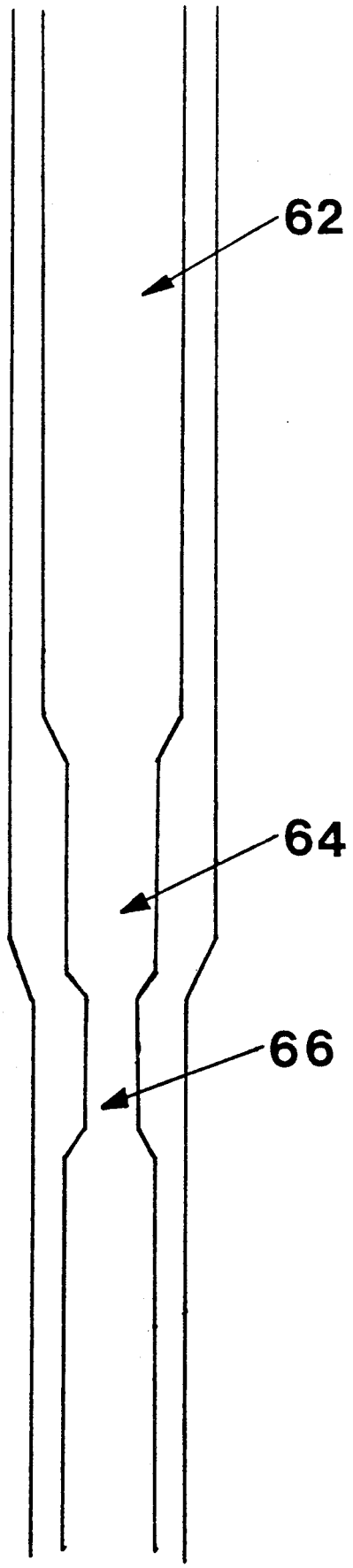
FIG. 5 is a longitudinal sectional view of a typical pipe used in the oil, gas or mining industry and down which the apparatus can travel.

It is common practice for pipes and well casings in the oil industry to be provided with sections of varying diameter. A profile of a typical section of casing used in the oil industries is illustrated in FIG. 5. It can be seen for example, that while anchor arm 20 may provide the anchoring action in the first pipe portion 62, the second arm 18 may provide the anchoring action in the reduced diameter pipe portion 64 and the smallest arm 16 may provide the anchoring action in the nipple 66.

When it is desired to withdraw the apparatus 2 from the pipe, the magnetic clutch 54 is de-energised. The deenergising of the magnetic clutch 54 allows the unthreaded portion 44 of the ball screw 30 to rotate freely in the crossbar 46. The closing spring 42, as it expands, forces against the flange 40 and causes the ball screw 30 to turn, winding itself into the shaft 32. The extension of the closing spring 42 pulls the closing block 34 towards the retractor casing, thereby causing the anchor arms 16, 18 and 20 to be retracted within the anchor casing 24.

FIGS. 6A & 6B illustrate another type of anchor 4 and retractor 8. The anchoring is provided by the anchor arms 68 and 70. Anchor arm 68 consists of two pivotally interconnected links 72 and 76. Link 72 is pivotally connected at one end to anchor casing 80. The opposite end of link 72 is pivotally connected to one end of link 76. The opposite end of link 76 is provided with a guide pin which rides in a first slot 82 formed in a shaft 86. Anchor arm 70 also consists of two pivotally interconnected links 74, 78. Link 74 is pivotally connected at one end to anchor casing 80 rearward of the connection of link 72 to the anchor casing 80 with respect to the direction of travel T. The opposite end of link 74 is pivotally connected to one end of link 78. The opposite end of link 78 is provided with a guide pin which rides in a second slot 84 formed in the shaft 86 rearward of the first slot 82 with respect to the direction of travel T. The shaft 86 is housed and extends within the anchor casing 80. A first flange 92 is formed around the shaft 86 between the slots 82 and 84, and a second flange 94 is formed around the shaft 86 rearward of the back slot 84. A first anchor spring 96 surrounds a portion of the shaft 86 between, and is retained by, the flange 92 and the guide pin 88. A second anchor spring 98 surrounds a portion of the shaft 86 between,and is retained in position by, the flange 94 and the guide pin 90. The anchor springs 96 and 98 urge respective anchor arms 68 and 70 to an upright position towards the inside surface of a pipe within which the apparatus is travelling so that anchoring may take place.

In FIGS. 6A & 6B the direction of travel T is towards the right. Anchoring is provided by the upper end of the links 72 and 74 gripping into the inner surface of a pipe when pulled in a direction opposite to the direction of travel. As with the example shown in FIGS. 2A & 2B, multiple anchor arms 68 and 70 are provided so as to anchor the apparatus 6 to pipes of varying diameters.

A portion of the shaft 86 furthest from the anchor arms 68 is provided with an internal thread 104 for receiving a ball screw 106. An unthreaded portion 108 of the ball screw 106 is rotatable mounted in a cross-bar 110 which transversely spans the inside of the anchor casing 80. Torque is imparted to the ball screw 106 by a magnetic clutch 118 driven by a motor 112, gear box 114 and torque set clutch 116. A closing spring 100 is provided around the shaft 86 and maintained in position between the flange 94 and stops 102, formed on the inner surface of the anchor casing 80 to the right of the flange 94.

The operation of the anchor 4 and retractor 8 will now be described. When no power is provided to the motor 112 and the magnetic clutch 118, the closing spring 100 is fully extended. When the spring 100 is fully extended, the shaft 86 is biased towards the left. This causes the right most edge of the slots 82 and 84 to engage with respective guide pins 88 and 90, thereby pulling the anchor arms downwards so as to retract them within the anchor casing 80. When power is supplied to the motor 112 and the magnetic clutch 118, the ball screw 106 rotates so as to push the shaft 86 towards the right and shown in FIG. 6. This compresses the spring 100. The torque set clutch 116 is set such that the spring 100 can be fully compressed. When the spring 100 is fully compressed, a micro-switch (not shown) turns off the motor 112 but keeps the magnetic clutch 118 energised. This prevents the ball screw 106 from turning thus maintaining the spring 100 in a compressed state. The anchor springs 96 and 98 urge the guides 80 and 90 respectively towards the right thereby extending the anchor arms 68 and 70 upwards out of anchor casing 80 so as to engage the inner surface of a pipe. When it is desired to withdraw the apparatus 2 from the pipe or casing, the magnetic clutch 118 is de-energised. This releases the ball screw 106 and allows it to rotate as the compressed closing spring 100 expands, forcing the shaft 86 to move towards the left. When this occurs, the right most portion of the slots 82 and 84 push the guide pins 88 and 90 towards the left, thereby causing the anchor arms 68 and 70 to be retracted within the anchor casing.

In a further embodiment the motor 48/112, gear box 50/114, torque setting clutch 52/116, magnetic clutch 54/118, ball screw 30/106 and internally threaded portion of the shaft 32/86 can be replaced by two solenoids. A first large solenoid is used to compress the closing springs 42/100 and a second small solenoid is used to control a catch for holding the closing springs in the compressed state. In this arrangement the first solenoid is energised to compress the closing spring. The second solenoid is simultaneously activated to hold closed a catch for maintaining the closing spring in a compressed state and thus the anchor arms in a pipe engaging position When the spring is in the compressed state a switch is tripped to de-energise the first solenoid. The anchor arms can be retracted by simply de-energising the second solenoid. By using two solenoids power draw is minimised as only a small solenoid needs to be energised for substantial periods of time.

The spring constant of the closing springs 42 and 100 should be relatively high so that respective anchor arms 16,18,20 and 68,70 are pulled down with considerable force. This assists in clearing away debris which may otherwise jam the anchor arms in a pipe engaging position Thus the likelihood of the apparatus being lost down and blocking a well is remote. It will be appreciated from the above description that in the event of a power failure or power cut off, as the magnetic clutch 118 will not be energised, the retractors will automatically close down the anchor arms.

In the unlikely event that the anchor arms become jammed or locked in a pipe engaging position a mechanical release mechanism can be used to apply additional force to close the anchors. Referring to FIGS. 2A & 2B, and 6A & 6B the mechanical release mechanism is formed by shear pins 41/101 which normally hold respective concentric casing members 45 & 47, and 105 & 107 in a wholly overlapping relationship. A rod or cable (not shown) attached to the left most end of the apparatus 2 completes the mechanical release element. If the anchor arms 16, 18, 20, or 68,70 become jammed a force is applied to the rod or cable in the direction opposite the direction of travel T. This force is transmitted to the shear pins 41 or 101. When the force exceeds a predetermined level the shear pins 41 and 101 fail. This causes the inner casing members 47/107 to move to the left relative to the outer casing members 45/105. Stops 51/111 formed on the inside surface of inner casing members 47/107 will now be brought into abutting contact with flanges 49/109 provided on the ball screws 30/106 between their respective threaded and unthreaded portions 44/108. At all times the ball screws 30/106 remain in threading engagement with respective shafts 32/86. Accordingly the force applied to the rod is now transmitted directly to the closing block 34 or slots 82,84. This force will, in all but the most extreme circumstances, close down the anchor arms 16, 18, 20 and 68, 70.

A propelling means suitable for use in an embodiment of the present invention, is illustrated in FIG. 7. The propelling means consists of a reciprocator 6 provided with a rotatable shaft 130. Cut in the shaft 130 is an endless thread having a clockwise thread portion 132 and an anticlockwise thread portion 134. A sleeve 136 surrounds the shaft 130 and is slidably retained in the reciprocator casing 138. A key 147 mounted on a swivel is attached to a rear portion of sleeve 136. The key 147 engages one of the threads 132, 134. When the motor 140 is activated, torque is imparted to the shaft 130 via the gear box 142. As the shaft 130 rotates, the key 147 rides in thread 132 and is forced to move towards the right and thereby causes the sleeve 136 to extend out of the reciprocator casing 138. When the key 147 reaches the far end of thread 132, it is directed into a change over thread 144. The change over thread 144 guides the key 147 from the clockwise thread 132 into the anticlockwise thread 134. A second change over thread 145 is provided at the other end of the shaft 130 to guide the key 147 from thread 134 to thread 132. A lug 141 formed on the outer peripheral wall of sleeve 136 rides in a longitudinal slot 143 provided in casing 138. The lug 141 and slot 143 prevent the sleeve 136 from rotating in the casing as the shaft 130 turns and causes the sleeve 136 to move in a straight line motion. With the direction of torque imparted to the shaft 130 maintained in the same direction, rotation of the shaft now causes the key 147 to ride in the anticlockwise thread 134 forcing it to move to the left, thereby causing the sleeve 136 to retract within the reciprocator casing 138. Hence by maintaining the direction of rotation on the shaft 130 the sleeve 136 cyclically extends out of and retracts within the shaft 138, thereby providing the reciprocating motion.

In a variation of the above reciprocator the double thread can be replaced with a single thread and the direction of rotation of the motor 140 cyclically reversed, thus causing the shaft 130 to be cyclically reversed.

Another type of suitable reciprocator is shown in FIG. 8. The reciprocating motion is provided by a chain drive mechanism 150, comprising a roller chain 170 engaging a crown gear 166 and sprocket 172, a rod 152 attached at one end to the chain and a plunger 154 attached to the other end of the rod 152. A gear box and motor 156 imparts torque to a shaft 158 rotatably mounted in a cross-bar 160 within the reciprocator casing 162. A bevel gear 164 is mounted at the end of the shaft 158 opposite the motor 156 and meshes with a crown gear 166. The crown gear 166 is provided with teeth 167 for engaging with the links 168 of a roller chain 170. The roller chain 170 extends around the crown gear 166 and a sprocket 172. One end of the rod 152 is pivotally attached to one of the links 168 of the roller chain 170. The other end of the rod 152 is pivotally attached to the head 174 of the plunger 154. The head 174 is provided with ball races 176 to reduce the friction as the plunger 154 reciprocates within the reciprocator casing 162.

When power is applied to the motor 156, the shaft 158 and bevel gear 164 are caused to rotate. Rotation of the bevel gear 164 imparts drive to the crown gear 166 which in turn, drives the chain 170 around the sprocket 172. As the chain 170 rotates, the rod 152 moves backwards and forwards thereby causing the plunger 154 to extend beyond and retract within the reciprocator casing 162, thus providing a reciprocating motion.

A cam operated hydraulic reciprocator is illustrated in FIG. 9. A motor and gear box 180 housed within the reciprocator casing 190 imparts drive to one end of a shaft 182. A bevel gear 184 is provided at the other end of the shaft and meshes with a crown gear 186. The crown gear in turn, meshes with a gear provided with a cam 188. A cam follower 192 is slidably mounted within the reciprocator casing 190 and at one end abuts the cam 188. The other end of the cam follower 192 is attached to a driving piston 194. The piston 194 is housed within a cylinder 196 which is filled with oil. Leading from the cylinder 196 is a second cylinder 198 of smaller diameter. Housed within the second cylinder 198 is a second piston 200 which is attached at its right end to a plunger 202. A volume of space 204 inside the reciprocator casing 190 between a sealing plate 206 and the rear of the driving piston 194 is in open communication with the atmosphere in the surrounding pipe by virtue of a perforated screen 208 provided in the wall of the reciprocator casing 190 between the rear of the driving piston 194 and the sealing plate 206.

As the cam 188 rotates, the follower 192 pushes the driving piston 194 towards the right and thereby forces the oil in cylinder 196 into the second cylinder 198. This in turn, causes the second piston 200 to move towards the right and therefore extend the plunger 202 out of the reciprocator casing 190 against the relatively high surrounding atmospheric hydrostatic pressure. The hydrostatic pressure in the space 204 acts on the surface of the piston 194 thereby assisting in the extension of the plunger 202. As the cam rotates past the point of maximum displacement, the hydrostatic pressure acting on the cam follower 192 in the space 204 and on the plunger 202, being substantially greater than the hydrostatic pressure behind the sealing plate 206, forces the plunger back into the casing 190. In this manner, the plunger 202 is cyclically extended and retracted thereby producing a reciprocating motion.

Another propelling means in the form of an impactor which imparts momentum to the apparatus in the direction of travel T, is illustrated in FIG. 10. The impactor 6 is provided with a casing 220 for housing a solenoid 222 and an armature 224. When an electrical current is applied to the solenoid 222 the armature 224 is propelled towards the right and impacts on the inside of the front wall 226 of the casing 220. When the electrical current is interrupted, the magnetic field created by the solenoid disappears and the armature 224 is returned to its rest position by means of a light spring 221. By alternately switching the electrical current through the solenoid 222 the armature 224 cyclically impacts with the inside of the front wall 226 of the casing 220 imparting momentum to the apparatus and causing it to be propelled in the forward direction.

Only one anchor portion is required with a self-propelled apparatus utilising the above propeller to cause the apparatus to be propelled in the direction of travel T. The anchor portion can be located at either end of the propeller to prevent the backstroke of the impactor from causing the apparatus to move in a direction opposite the direction of travel T.

The payload of the apparatus can be easily varied by adding any number of propellers and anchors to the apparatus.

Referring now to FIGS. 11A, 11B & 11C there is illustrated a self propelled apparatus 300 for travelling along a tubular pipe 302 and provide with driven wheels 304,305 coupled to gear boxes 306, 308 and 310 which are driven by a motor 312 for propelling the apparatus 300 in a direction of travel T towards the right. Arms 314, 316 and 318 which are pivotally interconnected in a concertina-like manner, together with spring 336, 340 bias the driven wheels 304,305 into contact with the inside of the pipe 302. The left end of arm 318 when forced to the left retracts the wheels 304,305 away from the pipe 302.

The left end of arm 318 is attached to a connecting rod 320 via a slidable pivot pin 322 which resides in a first slot 324 cut in the body of the apparatus 300. The other end of arm 318 is connected by a pivot pin 326 to one end of the arm 316. The other end of arm 316 is attached by a pivot pin 328 to one end of arm 314. The other end of arm 314 is attached via a pivot pin 330 to the body of the apparatus 300 at a point disposed to the right of slot 324.

The connecting rod 320 is slidably housed in the apparatus 300 and is provided at the end distal the arm 318 with a flange 332, and at the other end with a head 334 which is connected to the arm 318 by the pivot pin 322. A first resilient element in the form of a first spring 336 housed in the apparatus between one side of a bulk head 338 and the head 334, urges the arms 314, 316 and 318 in the upright position so that the wheels 304,305 contact the inside surface of the pipe 302. A second resilient element in the form of a second spring 340 is housed in the apparatus 300 between the other side of the bulk head 338 and an actuating cylinder 342. The actuating cylinder 342 encloses the flange 332 of the connecting rod 320. One end of the actuating cylinder 342 is attached by a ball nut 344 to a ball screw 346. The ball screw 346 is held within a thrust bearing 348, and is driven by an electric motor 350, a gear box 352, an electromagnetic clutch 354 and second gear box 356. The electric motor 350 and clutch 354 acts as a compressing means to compress the second spring 340 as will be explained in more detail below.

The operation of the apparatus 300 will now be described. When no power is supplied to the apparatus 300 and the compressing means deactivated, the second spring 340 having a higher spring constant than the first spring 336 expands and urges the actuating cylinder 342 away from the arms 314, 316, 318. As no power is supplied to the electromagnetic clutch 354, the ball screw 346 is able to rotate within the thrust bearing 348. Accordingly, as the second spring 340 expands the actuating cylinder is urged away from the arm 318 and collects the flange 332 of the connecting rod 320. The movement of the connecting rod 320 to the left pulls the arms 314, 316 and 318 towards the body of the apparatus 300 therefore causing the arms to retract and moving the wheels 304,305 away from contact with the inside surface of the pipe 302.

When the compressing means is activated, power is applied to the electric motor 350 and the magnetic clutch 354 and the ball screw 346 turns in the thrust bearing 348. The ball nut 344, engaging the ball screw 346, travels towards arm 318 and causes the actuating cylinder 342 to compress the spring 340 against the bulk head 338. When the spring 340 is fully compressed a micro-switch (not shown) disconnects power to the electric motor 350 but maintains power to the electromagnetic clutch 354. While the electromagnetic clutch 354 is powered the ball screw 346 is prevented from rotating in the thrust bearing 348 and therefore the second spring 340 is prevented from expanding and pushing the actuating cylinder away from the arm 318. When the second spring 340 is compressed, the first spring 336 is able to expand and urges the head 334 of the connecting rod 320 to the right. This urges the arms 314, 316 and 318 and wheels 304,305 into a driving position wherein the wheels 304,305 are in contact with the inside surface of the pipe 302.

Application of power to the motor 312 causes the drive shaft 358 to turn which imparts drive to gear box 306. Gear box 306 meshes with gear box 308 disposed on the arm 314 and imparts torque to the drive wheel 304 so as to drive the wheel 304 in a clockwise direction A geared hub 311, of wheel 304 in turn, imparts drive to a third gear box 310 disposed on the arm 316. The second gear wheel 364 of the gear box 310 is rotatable mounted on a pivot pin 360 passing perpendicularly through the arm 316 and residing in a slot 362. The slot 362 is cut in the apparatus 300 between the first slot 324 and the pivot pin 330. The end gear wheel of gear box 310 imparts torque to the drive wheel 305 so as to cause the drive wheel 305 to rotate in an anticlockwise direction. When the wheels 304 and 305 rotating in a clockwise and anti-clockwise direction respectively, the apparatus 300 is propelled in the direction of travel T. In order to increase a traction between the wheels and the inside surface of the pipe 302 the wheels 304 and 305 may be provided with rubber tread or pointed dogs.

It will be appreciated that if a force is applied to the apparatus 300 in a direction opposite the direction of travel T the bias maintaining the wheels 304 and 305 into contact with the pipe 302 will increase due to the concertina arrangement of the arms 314, 316 and 318. Specifically, the arm 316 being pivoted on pivot pin 360 and having wheels 304 and 305 in contact with the pipe 302 will pivot in a clockwise direction in reaction to a force applied in a direction opposite the direction of travel T thereby increasing the contact force between the wheels 305, 304, and the pipe 302. When power to the motor 312 is turned off, the gearing to the wheels 304, 305 provided by the gear boxes 306, 308 and 310 prevent the wheels 304, 305 from rotating in an anticlockwise and clockwise directions respectively. In this situation the arms 314, 316 and 318 and the wheels 304 and 305 act as anchors to maintain the apparatus in a given position.

When it is desired to retract the apparatus from the pipe the electromagnetic clutch 354 is deactivated. This allows the ball screw 346 to rotate in the thrust bearing 348. Accordingly, the spring 340 can now expand and push the actuating cylinder 342 to the left. The actuating cylinder collects the flange 332 on the connecting rod 320 thereby causing the connecting rod to move to the left. This in turn pulls the arm 318 to the left along the slot 324 causing the arm 316 to rotate about the pivot pin 360 in a anti clockwise direction thereby disengaging the wheels 304, 305 from contact with the pipe 302.

The apparatus 300 is provide with an upper casing 366 attached to and adjacent lower casing 368 disposed to the right of the upper casing. The upper casing is provided with an inner sleeve 370 of smaller diameter which projects into the lower casing 368 and is attached thereto by shear pins 372. In the event that the arms 314, 316 and 318 become locked in a position anchoring the apparatus to the pipe 302, force may be applied to the apparatus 300 in a direction opposite the direction of travel T to break the shear pins and retract the wheels 304, 305 from the pipe 302. When the shear pins break from the application the force the upper casing 366 moves to the left relative to the lower casing 368. As the upper casing 366 moves in this direction, the bulk head 338, and actuating cylinder 342 are also carried to the left. The actuating cylinder 342 collects the flange 332 thereby connecting the connecting rod 320 directly to the applied force. This force is transmitted through the connecting rod 320 to the pivot pin 322 and forces the arms 314, 316 and 318 into a retracted position.

A further embodiment of a self-propelled apparatus 400 for travelling along a tubular member or shaft in accordance with the present invention is shown in FIGS. 12A-12E. The apparatus 400 has an outer casing 402 made from a plurality of threadingly interconnected tubular outer sleeves 404. All of the component parts of the apparatus 400 are housed within the outer casing 402 except for the conductors 417, 419 and 540 which are located in grooves (not shown) formed on the outer casing 402. Starting from the left most end of the apparatus 400 there is a threaded recess 406 for receiving a plug (not shown) connected to a retrieval and control cable. The retrieval and control cable (not shown) provides power and control signals to the apparatus 400 as well as a means for pulling the apparatus 400 out of the tubular member or shaft. An electrical contact 408 mates with the plug received in the recess 406 and supplies electrical power to the apparatus 400. A pair of driven wheels 410, 411 for propelling the apparatus 400 in the direction of travel T towards the right are located within the outer casing 402 at an end opposite the recess 406. An electric motor 412, gear box 414, electromagnetic clutch 416, ball screw 418, actuating shaft 420, springs 478, 480, and pivoting arms 486, 488, 492, 494 cooperate so as to bias the driven wheels 410, 411 from the outer casing 402 and into contact with an inner surface of the shaft or tubular member to facilitate propulsion of the apparatus 400.

An electric conductor 417 connects the contact 408 to a microswitch 424 and the electromagnetic clutch 416. A second electric conductor 419 connects the microswitch to the electric motor 412 via electrical contact 422. When the microswitch 402 is open, electrical current is supplied to the electrical motor 412. The electric motor 412 imparts drive to the gear box 414 and causes rotation of gear box shaft 426. The gear box shaft 426 is coaxially coupled to drive shaft 428. The end of the drive shaft 428 opposite the gear box shaft 426 is connected by a slip joint 434 to a first shaft 436 of the electromagnetic clutch 416. The first shaft 436 is integral with a first pressure plate 438 of the magnetic clutch 416 The motor 412 and clutch 416 act as a compressing means to compress spring 480 as will be explained in more detail below.

When the magnetic clutch 416 is not activated, a second pressure plate 440 of the magnetic clutch 416 is spaced opposite the first pressure plate 438. Integral with the second pressure plate 440 is a transmission shaft 442. Coaxially connected with the transmission shaft 442 is a fine threaded shaft 444. An end of the fine threaded shaft 444 opposite the transmission shaft 442 is devoid of thread and is retained so as to rotate within a support 446. A keyed nut 448 threadingly engages the fine threaded shaft 444. The fine threaded shaft 444, support 446 and keyed nut 448 are housed within a cylindrical tube 450. A slot 452 is cut along a top portion of the tube 450. The keyed nut 448 is provided with a key which can slide within the slot 452. Thus, as the fine threaded shaft 444 rotates, the keyed nut 448 travels linearly of the shaft 444 in a direction dependent upon the direction of rotation of the shaft 444. The keyed nut 448 is further provided with a finger 454 which is adapted to pass through a complementary hole 456 formed in the support 446. When the keyed nut 448 travels to the end of the threaded shaft 444 adjacent the support 446, the finger 454 passes through the hole 456 and closes the microswitch 424. This in turn disconnects power to the electric motor 412.

An end of the fine threaded shaft 444 opposite the transmission shaft 442 is coaxially connected with a transmission coupling 458. The transmission coupling 458 is supported intermediate its length by a ball bearing 460 and roller thrust bearing 462.

Coaxially connected with the transmission coupling 458 is the ball screw 418. A ball screw nut 464 threadingly engages the ball screw 418. A sliding sleeve 466 is placed over the ball screw 418 adjacent the ball screw nut 464. A portion of the outer surface of each of the ball screw nut 464 and the sliding sleeve 466 at adjacent ends is formed with an outer thread. An adaptor 468 threadingly engages the outer surface thread on the ball screw nut 464 and the inner sleeve 466 thereby connecting the ball screw nut and the sliding sleeve together. The sliding sleeve 466 extends beyond the length of the ball screw 418. An end of the sliding sleeve 466 away from the ball screw 418 is provided with a pair of opposite longitudinal blind slots 470.

A portion of the actuating shaft 420 is slidably retained within the sliding sleeve 466 in the vicinity of the longitudinal slots 470. A rectangular hole 472 is formed intermediate the length of the actuating shaft 420. The actuating shaft 420 is slidably retained within the sliding sleeve 466 by means of a T-lock 474. In this regard, the actuating shaft 420 is placed within the sliding sleeve 466 so that the rectangular hole 472 is aligned with the longitudinal blind slots 470. The T-lock 474 is then inserted through the longitudinal slot 470 and into the rectangular hole 472. The T-lock 474 is arranged so that its arms T extend perpendicular to the length of the actuating shaft 420 into and beyond the longitudinal slots 470. The T-lock 474 is prevented from falling out of the rectangular hole 472 by a retaining ring 476 which is placed over the sliding sleeve 466 and abuts the T-lock 474. The actuating shaft 420 is supported intermediate its length by a support bush 471.

An inner spring 478 surrounds the sliding sleeve 466 and is located between the adaptor 468 and the retaining ring 476. An outer spring 480 surrounds the inner spring 478 and is located between the adaptor 468 and an inner fixed sleeve 482 which is connected to the inside of the outer casing 402 in the vicinity of the T-lock 474 and retaining ring 476. The outer spring 480 has a high spring constant than the inner spring 478.

An opposite end of the actuating shaft 420 is connected by a sliding pivot pin 484 to a pair of support arms 486 and 488. At opposite ends of the support arms 486, 488 is mounted respective driving wheels 410 and 411. The driving wheels 410 and 411 are mounted on respective axles 490 and 491. One end of a gear train arm 492 pivots on axle 490. Similarly, one of end of gear train arm 494 pivots on axle 491. The opposite ends of gear train arms 492 and 494 are pivotally connected to coaxial stationary pivot pins 496, 497. Connected to gear train arm 492 are four adjacent intermeshing gears 498, 499, 500 and 501. Gear 498 is rotatable mounted on pivot pin 497. Gear 501 is rotatable on axle 490 and imparts drive to driving wheel 410. A bevel gear 502 is rotatable mounted on pivot pin 496 and is connected with gear 498 so that bevel gear 502 and gear 498 rotate in unison.

A similar arrangement of gears 504, 505, 506 and 507 and bevel gear 508 are provided for gear train arm 494. Gear 507 is rotatable mounted on axle 491 and imparts drive to driving wheel 411. Gear 504 is connected with bevel gear 508 so that bevel gear 508 and gear 507 rotate in unison.

When the apparatus 400 is in a de-activated state, the support arms 486, 488 are colinear with the gear train arms 492, 494 will at the arms 486, 488, 492 and 494 located within the outer casing 402. The support arms 486, 488 are each provided with a reduced thickness portion in the vicinity of respective axles 490, 491. The driving wheels 410, 411 are located in a space between the support arms 486, 488 formed by the reduced thickness portions. The gear train arms 492, 494 are spaced so that the driving wheels 410, 411 and support arms 486, 488 lie therebetween.

The bevel gears 502 and 508 are driven by a common transmission gear in the form of a bevel gear pinion drive 510. The bevel gear pinion drive 510 is supported intermediate its length by ball bearings 512 and 513. The pinion drive 510 is coaxially connected with a drive shaft 514.

The drive shaft 514 is coaxially connected to a gear box shaft 535 of gear box 536. The gear box 536 is driven by a second electric motor 538. Electric current is supplied to the second electric motor 538 via a conductor 540 connected to the microswitch 524.

The outer casing 402 is provided with openings (not shown) in the vicinity of the support arms 486, 488 and gear train arms 492, 494 for allowing the driving wheels 410, 411 to extend out of the casing 402 and into contact with an inner surface of the tubular member or shaft through which the apparatus 400 is travelling. Longitudinal guides or slots (not shown) are also provided on the side of the outer casing 402 to guide the sliding of sliding pivot pin 484.

A substantial portion of the length of the drive shafts 428 and 514 are housed within respective identical sealing/thrust adaptors 516. The adaptors 516 consist of a hollow cylinder-like adaptor body 518 through which the drive shaft 428/514 passes. An end of the adaptor body 518 facing the centre of the apparatus 400 is closed with a retaining cap 520. A seal 521 is located adjacent the drive retaining cap 520 inside the adaptor body 518 through which the drive shaft 428/514 passes. Interior of the adaptor body 518 and adjacent the seal 521 is a compensating piston 522. The drive shaft 428/514 passes through the centre of the compensating piston 522. Spaced from the compensating piston 522 and housed within the adaptor body 518, is a roller thrust bearing 524 supporting the drive shaft 514. The space between the compensating piston 522 and thrust bearing 524 is filled with oil to form an oil buffer 526. Part of the drive shaft 428/514 extends through a neck 527 in the adaptor body 518 and into an outer recess 529 formed in the adaptor body 518. Oil from the oil buffer 526 is prevented from passing through the neck in the adaptor body 518 by means of a ring-like seal 528 and hat-shaped seal block 530 which surround an end portion of the drive shaft 514. The adjacent end of the drive shaft 514 is supported in a ball bearing 532. The ball bearing 532, seal block 530 and ring seal 528 are maintained in position by means of a circlip 534 which sits in a groove formed in the outer recess 529 of the adaptor body 518.

The electric motors 412 and 538 and gear boxes 414 and 536 are located in an atmospheric air chamber which is isolated from the outerside environment by respective sealing/thrust adaptors 516 which are capable of withstanding the pressure differential and including an oil buffer. The electromagnetic clutch 416, microswitch 424, ball screw 418 and springs 478, 480 are all within an oil filled housing equalised to outside pressure by means of a compensating piston 542. The compensating piston is located about the actuating arm 420 between the T-lock 474 and sliding pivot pin 484.

The operation of the apparatus 400 is as follows. When power is supplied to the apparatus 400 the compressing means is activated as electric current flows through conductor 417 to activate the electromagnetic clutch 416 whereby rotation of the first shaft 436 results in rotation of the transmission shaft 442. At the same time, electric current is supplied to the electric motor 412 via the microswitch 424 and conductor 419. With the clutch activated, torque from electric motor 412 is transmitted to the ball screw 418 which rotates, causing forward movement (towards the right) of the ball screw nut 464, adaptor 468 and sliding sleeve 466. The outer spring 480 is compressed between the adaptor 468 and the inner sleeve 482. The actuating shaft 420 is held in the longitudinal slots 470 of the sliding sleeve 466 by the T-lock 474 and retaining ring 476. The inner spring is slightly preloaded thus keeping the T-lock 474 to the far end of the slots 470. The inner spring 478, sliding sleeve 466 and actuating shaft 420 all move forward causing the sliding pivot pin 484 to also move along the longitudinal guides. This in turn biases support arm 486 and driving wheel 410 to extend upwardly out of the casing 402 and, simultaneously the support arm 488 and driving wheel 411 downwardly out of the casing 402, until both wheels contact an inner surface of the tubular member or shaft, reaching the driving position. The driving wheels are forced to extend from the casing 402 in opposite directions due to the bevel gear 510 which prevents bevel gears 502 and 508 from rotating in the same direction. When the arms 486, 488 meet the resistance of this inner surface the actuating shaft 420 will stop moving forward and any further movement of the sliding sleeve 466 will result in compression of the inner spring 482. After a preset number of revolutions of the ball screw 418 the keyed nut 448 on the fine threaded shaft 444 removes sufficiently forward so as to close the microswitch 424. This switches electric current from electric motor 412 to electric motor 538 via conductor 540. All the time however, electric current is maintained to the electromagnetic clutch 416.

Electric motor 538 imparts drive to the bevel gear pinion drive 510 through the gear box 536, gear box shaft 534 and drive shaft 514. Rotation of the bevel gear 510 causes rotation of the bevel gears 502 and 508 in opposite directions. For example, if the pinion gear 510 is rotated in an anticlockwise direction by the electric motor 538, than bevel gear 502 rotates in a clockwise direction and bevel gear 508 in an anti-clockwise direction. Due to the meshing of gears 498, 499, 500 and 501, driving wheel 410 rotates in a direction opposite to that of bevel gear 502. That is, driving wheel 410 rotates in an anti-clockwise direction. Similarly, due to the meshing of gears 504, 505, 506 and 507, driving wheel 411 rotates in an opposite direction to bevel gear 508, namely in a clockwise direction.

By virtue of the above arrangement, optimum pressure between the inner surface of the tubular member or shaft on the driving wheels is obtained using the torque created by the electric motor 538 and the apparatus 400 is able to travel along shafts of varying diameter. Any force acting against rotation of the driving wheels 410, 411 will cause the gear train to "torque up" and act similar to a lever pivoted on the pivot pins 496, 497. The gear train arms 492, 494 will move in the same direction as the rotation of the respective bevel gears 502, 508. When a force equal to that which is opposing the rotation of the wheels is applied to the gear train arm in a direction opposite to that of the corresponding bevel gear, the corresponding wheel will rotate. Accordingly, if a force is applied against the direction of travel, while the driving wheels are in contact with the inner surface of a tubular member or shaft (that is with the wheels in the driving position), then that force is directly opposing the rotation of the driving wheels. Because of the "torquing up" effect, the gear train arms will apply extra pressure to the surface of the tubular member or shaft until it equals the force opposing the direction of travel. The wheels will then rotate and move the apparatus forward.

If power is disconnected to the apparatus 400, the electromagnetic clutch 416 is deactivated and the pressure plates 438 and 400 disengage so that the transmission shaft 442 is free to rotate. The compressive force exerted by the outer spring 480 on the adaptor 468 will cause the ball screw 418 to rotate moving the ball screw nut 464 to the left. The sliding sleeve 466 will also retract to the left pulling with it the actuating shaft 420, resulting in the support arms 486, 488 and the gear train arms 492, 499 to be retracted within the outer casing 402. The apparatus 400 can now be withdrawn by pulling on the retrievable cable in a direction opposite to the direction of travel T.

The apparatus 400 is further provided with a pair of shear pins 544 which connect the outer casing 402 with the inner sleeve 482. If, for some reason, the driving wheels 410 and 411 remain in a driving position in contact with the tubular member or shaft when power is disconnected and the apparatus 400 is stuck, the retrieval cable is pulled back until the shear pins 544 are caused to shear. When this occurs, the inner sleeve 482 will slip from within the outer sleeve 404. This results in a transfer of the pulling force from the stationery pivot pins 496, 497 to the sliding pivot pin 484 which will pull the arms 486, 488 into the casing 402 and disengage the wheels 410, 411 from the tubular member or shaft.

Now that preferred embodiments of the self propelled apparatus for travelling down a tubular member have been described in detail, it will be apparent to those skilled in the mechanical arts that numerous modifications and variations may be made to the apparatus without departing from the basic inventive concepts. For example the anchor means illustrated in FIGS. 2A and 2B; and 6A and 6B are provided with mechanical arms for gripping an inside surface of a pipe. However, other anchor means such as electromagnetic pads, suction pads, inflatable hydraulic or pneumatic bags, or hydraulic or pneumatic rams may be used.

Furthermore with reference to FIGS. 11A, 11B & 11C the second spring 340 may be compressed by a first solenoid acting on the actuating cylinder 342 instead of the electric motor 350, gear box 352, electromagnetic clutch 354, gear box 356, ball screw 346 and ball nut 344. In this arrangement the solenoid when energised acts against the actuating cylinder 342 and compresses the spring 340. A second smaller solenoid drawing much less power, is also used to operate a catch to maintain the spring in a compressed state, so that the first mentioned solenoid may be deactivated to reduce power draw. By cutting off power to the second smaller solenoid the spring 340 will be free to expand and operate to retract the arms 314, 316 and 318. All such variations and modifications are to be considered within the scope of the invention, the nature of which is to be determined from the foregoing description.

We claim:

1. A self-propelled apparatus, driven by a power, for travelling along a tubular member or shaft comprising:

driven wheels for propelling said apparatus in a direction of travel, the driven wheels being powered by the power;

means for biasing said wheels into a driving position in contact with an inner surface of said tubular member or shaft whereby drive can be imparted by said wheels against said inner surface to propel the apparatus in the direction of travel, said biasing means being powered by the power, said biasing means including:

first and second support arms, each support arm having a first end pivotably connected to a common slidable pivot pin;

first and second gear arms, each gear arm having a first end pivotably connected to a second end of a respective support arm by means of an axle, second ends of a respective support arm by means of an axle, second ends of each gear arm being pivotably connected to coaxial stationary pivot pins, wherein each wheel is rotatably mounted on respective axles and each gear arm is provided with at least one gear for transmitting torque to a corresponding one of said wheels and each of said at least one gear is driven by a common transmission gear; and means for retracting said wheels from said driving position whereby said apparatus can be withdrawn from said tubular member or shaft in a direction opposite the direction of travel, said retracting means further arranged so as to automatically retract said wheels from said driving position when the power to the apparatus is cut-off.

2. Apparatus according to claim 1, wherein when said driven wheels are in said driving position a torque of said wheels increases the traction of said wheels in response to the force applied in the direction opposite to the direction of travel.

3. Apparatus according to claim 2, wherein said slidable pivot pin is arranged for linear translation in a direction substantially parallel to the direction of travel.

4. Apparatus according to claim 1, wherein said biasing means includes first and second resilient elements, said first resilient element arranged to bias said wheels toward said inner surface, said second resilient element arranged to bias said wheels away from said inner surface; and compressing means for overcoming the bias provided by the second resilient element, whereby when said compressing means is activated said compressing means operates to overcome the bias of the second resilient element, and said first resilient element biases said wheels toward and into contact with said inner surface, and when said compressing means is deactivated, said second resilient element acts to retract said wheels away from and out of contact with said inner surface.

5. An apparatus according to claim 1, further comprising a slidable sleeve connected to a retrieval cable and further connected to an outer casing of said apparatus by means of at least one shear pin, whereby in the event of said wheels not disengaging said inner surface when the power is cut-off, on application of a predetermined tensile force on said retrieval cable, said shear pin is adapted to break to allow said sleeve to slide along said outer casing and engage said retracting means so that the tensile force is applied to said retracting means to disengage said wheels from said inner surface to allow said apparatus to be withdrawn from the tubular member or shaft.

6. An apparatus according to claim 1, wherein each gear arm is provided with an even number of gears for transmitting torque to a corresponding one of said wheels and said gears on each gear arm are driven by a common transmission gear.

7. A self-propelled apparatus, driven by a power, for travelling along a tubular member or shaft comprising:

means for propelling said apparatus in a direction of travel, the propelling means being powered by the power, the propelling means comprising driven wheels;

means for biasing said propelling means into a driving position in contact with an inner surface of said tubular member or shaft whereby drive can be imparted by said propelling means against said inner surface to propel said apparatus in the direction of travel, the biasing means being powered by the power, the biasing means increasing the bias on the propelling means when in the driving position in response to a force applied to the apparatus in the direction opposite the direction of travel, the biasing means including:

first and second resilient element, said first resilient element arranged to bias said wheels towards said inner surface, said second resilient element arranged to bias said wheels away from said inner surface; and compressing means for overcoming the bias provided by the second resilient element, whereby, when said compressing means is activated said compressing means operates to overcome the bias of the second resilient element, and said first resilient element biases said wheels towards and into contact with said inner surface, and when said compressing means is deactivated, said second resilient element acts to retract said wheels away from and out of contact with said inner surface; and means for retracting said propelling means from said driving position whereby said apparatus can be withdrawn from said tubular member or shaft in a direction opposite the direction of travel, said retracting means further arranged so as to automatically retract said propelling means from said driving position when the power to said apparatus is cut-off;

wherein said biasing means and said propelling means, when in said driving position, are arranged to substantially prevent movement of the apparatus in the direction opposite the direction of travel.

8. Apparatus according to claim 7, wherein said bias means further includes an arm connected intermediate its length to a pivot pin with said wheels rotatably connected at opposite ends of said arm, said pivot pin residing in a slot in said apparatus, and bias from said first resilient element is transmitted to said arm so as to urge said arm to pivot about said pivot pin and said wheels to contact said inside surface when said compressing means is activated.

9. Apparatus according to claim 7, wherein said biasing means further includes:

first and second support arms, each support arm having a first end pivotally connected to a common slidable pivot pin; and first and second gear arms, each gear arm having a first end pivotally connected to a second end of a respective support arm by means of an axle, second ends of each gear arm being pivotably connected to coaxial stationary pivot pins;

wherein each wheel is rotatably mounted on respective axles, and bias from said first resilient element is transmitted to said support arm and gear arms so as to urge said wheels into contact with the inner surface when said compressing means is activated.

10. Apparatus according to claim 9, wherein said slidable pivot pin is arranged for linear translation in a direction substantially parallel to the direction of travel.

11. Apparatus according to claim 10, wherein each gear arm is provided with at least one gear for transmitting torque to a corresponding one of said wheels and each of said at least one gear is driven by a common transmission gear.

12. A self-propelled apparatus driven by a power, for travelling along a tubular member or shaft comprising:

means for propelling said apparatus in a direction of travel, the propelling means being powered by the power;

means for biasing said propelling means into a driving position in contact with an inner surface of said tubular member or shaft whereby drive can be imparted by said propelling means against said inner surface to propel said apparatus in the direction of travel, the biasing means being powered by the power;

means for retracting said propelling means from said driving position whereby said apparatus can be withdrawn from said tubular member or shaft in a direction opposite the direction of travel, said retracting means further arranged so as to automatically retract said propelling means from said driving position when the power to said apparatus is cut-off; and a slidable sleeve connected to a retrieval cable and further connected to an outer casing of said apparatus by means of at least one shear pin, whereby in the event of said propelling means not disengaging said inner surface when the power is cut-off, on application of a predetermined tensile force on said retrieval cable said shear pin is adapted to break to allow said sleeve to slide along said outer casing and engage said retracting means so that said tensile force is applied to said retracting means to disengage said propelling means from said inner surface to allow said apparatus to be withdrawn from said tubular member or shaft.

* * * * *